US008414105B2

(12) United States Patent
Komuro et al.

(10) Patent No.: US 8,414,105 B2
(45) Date of Patent: Apr. 9, 2013

(54) IMAGE FORMING APPARATUS

(75) Inventors: Ichiro Komuro, Kanagawa (JP); Shinichiro Naruse, Kanagawa (JP); Mamoru Yorimoto, Tokyo (JP); Ryusuke Mase, Kanagawa (JP); Soichi Saiga, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 161 days.

(21) Appl. No.: 12/964,066

(22) Filed: Dec. 9, 2010

(65) Prior Publication Data

US 2011/0141192 A1 Jun. 16, 2011

(30) Foreign Application Priority Data

Dec. 11, 2009 (JP) ..... 2009-282267
Mar. 17, 2010 (JP) ..... 2010-061178

(51) Int. Cl.
*B41J 2/165* (2006.01)

(52) U.S. Cl. ..... 347/37

(58) Field of Classification Search ..... None
See application file for complete search history.

(56) References Cited

U.S. PATENT DOCUMENTS

2008/0238996 A1* 10/2008 Takada et al. ..... 347/37
2010/0295897 A1 11/2010 Naruse et al.

FOREIGN PATENT DOCUMENTS

JP 2785031 5/1998
JP 2003-162137 6/2003
JP 2005-271531 10/2005
JP 3982519 7/2007
JP 2007-223232 9/2007

* cited by examiner

*Primary Examiner* — Lamson Nguyen
*Assistant Examiner* — Alejandro Valencia
(74) *Attorney, Agent, or Firm* — Cooper & Dunham LLP

(57) ABSTRACT

An image forming apparatus including a first carriage having a first recording head and a first lifting/lowering unit, a second carriage having a second recording head and a second lifting/lowering unit, a drive source, a drive coupling unit provided to the drive source, a first coupling unit, a second coupling unit, a docking/separation unit that docks and separates the first and second carriages, and an accommodation/coupling unit. A first end of the second coupling unit is coupled to the drive coupling unit, and the accommodation/coupling unit couples the first coupling unit to a second end of the second coupling unit and accommodates the first coupling unit within the first carriage to uncouple the first coupling unit from the second end of the second coupling unit. Accommodation and coupling of the first coupling unit are performed in conjunction with docking and separation of the first and second carriages.

17 Claims, 34 Drawing Sheets

IMAGE FORMING APPARATUS

BACKGROUND

1. Technical Field

This disclosure relates generally to an image forming apparatus employing an inkjet system such as a printer, a copier, and a facsimile machine.

2. Description of the Background Art

An image forming apparatus employing an inkjet system uses a recording head including a liquid ejection head that ejects droplets of a recording liquid such as ink onto a recording medium to form images on the recording medium. In order to reliably eject ink droplets from the recording head moving reciprocally back and forth to target positions on the recording medium, a distance between a nozzle surface of the recording head and a surface of the recording medium is required to be kept constant regardless of a thickness of the recording medium.

In one example of a related-art image forming apparatus, recording heads are installed on a single carriage for protection of the recording heads. A mechanism that adjusts a height of the carriage to keep constant a distance between nozzle surfaces of the recording heads and a surface of a recording medium vertically moves the carriage mounting the recording heads upward and downward together with a guide rod that movably supports the carriage in a main scanning direction. The mechanism includes two eccentric cams operated by an operation lever via a link mechanism, thereby requiring a certain amount of space for the operation lever to slide and making it difficult to make the image forming apparatus more compact. Further, adjustment of the height of the carriage is not automatically performed but must be manually operated by a user.

In another example of a related-art image forming apparatus, a holder member that holds multiple recording heads installed on a single carriage is provided. The holder member is disposed on multiple eccentric cams arranged parallel to each other within the carriage. The multiple eccentric cams are simultaneously rotated at the same angle using a gap adjustment lever so that the multiple recording heads are lifted and lowered together with the holder member. However, although the eccentric cams are coupled to each other by racks and pinions, one of the eccentric cams is rotated by the gap adjustment lever, thereby still requiring a certain amount of space for the gap adjustment lever to slide even though the gap adjustment lever is automatically rotated. Consequently, it is difficult to make the image forming apparatus more compact.

In yet another approach, an image forming apparatus includes a first carriage including recording heads that eject monochrome ink droplets and a separate second carriage including recording heads that eject color ink droplets to form both monochrome and full-color images. The second carriage is separatably dockable with the first carriage so that unnecessary waste of color ink ejected for maintenance even during monochrome image formation is prevented and the recording heads installed on the second carriage can be protected during monochrome image formation. Specifically, only the first carriage is driven during monochrome image formation so that the recording heads of the second carriage are not driven and are protected, thereby preventing unnecessary waste of the color ink. Because various types of recording media having different thickness are used in the image forming apparatus, it is necessary to adjust a gap between a surface of each of the recording media and nozzle surfaces of the recording heads respectively mounted on the first and second carriages based on the thickness of the recording media in order to keep the gap constant. However, a technique for adjusting the gap is not disclosed for the image forming apparatus.

There is also known a technique relating to engagement and disengagement of a coupling member of a toner cartridge and a driving part of an image forming apparatus. The toner cartridge includes a developer conveyance member that rotates on a rotary shaft thereof. A drive transmission unit that receives a driving force from the image forming apparatus is movable in a direction parallel to the rotary shaft of the developer conveyance member. Specifically, the drive transmission unit is movable between a first position where the drive transmission unit receives the driving force from the image forming apparatus and a second position where the drive transmission unit is isolated from the driving force from the image forming apparatus. Accordingly, the toner cartridge is more easily attached to and detached from the image forming apparatus. However, the above-described technique is related neither to lifting and lowering the carriages to adjust the gap between the nozzle surfaces of the recording heads and the surfaces of the recording media nor docking and separation of the first and second carriages.

As described above, docking and separation of the first and second carriages performed depending on colors used for image formation and lifting and lowering the recording heads respectively installed on the first and second carriages based on the thickness of the recording media are disclosed as two separate techniques unassociated with each other in the related-art image forming apparatuses employing the inkjet system. Further, a technique that lifts and lowers the recording heads using a single drive source other than human power, such as a motor, is not yet disclosed. Meanwhile, there is increasing demand for making the configuration of the image forming apparatuses simpler and more compact.

SUMMARY

In this disclosure, an improved image forming apparatus employing an inkjet system is provided to form images on various types of recording media having different thickness using two separate carriages. The image forming apparatus includes a first carriage mounting recording heads that eject black liquid droplets and a second carriage mounting recording heads that eject color liquid droplets. The first and second carriages are separatably dockable with each other. The image forming apparatus further includes a mechanism such that docking and separation of the first and second carriages depending on colors used for image formation is performed in conjunction with coupling and uncoupling of a drive transmission unit that transmits a driving force for lifting and lowering the recording heads of the first and second carriages based on the thickness of the recording media. The mechanism is associated with a lifting/lowering unit that lifts and lowers the recording heads of the first and second carriages in the image forming apparatus, thereby making the configuration of the image forming apparatus simpler and more compact. In addition, when there is a difference in heights between the recording heads of the first and second carriages, the heights of the recording heads are adjusted while the first and second carriages are not docked with each other but are separated. After adjustment of the heights of the recording heads, the first and second carriages are docked with each other so that a distance between a nozzle surface of each of the recording heads and surfaces of the recording media is kept constant, thereby providing higher quality images.

In one illustrative embodiment, an image forming apparatus includes a first carriage movable in a main scanning direction and having a first recording head and a first lifting/lowering unit that moves the first recording head upward and downward in a direction perpendicular to a surface of a recording medium; a second carriage movable in the main scanning direction and having a second recording head and a second lifting/lowering unit that moves the second recording head upward and downward in the direction perpendicular to the surface of the recording medium; a drive source that drives the first and second lifting/lowering units; a drive coupling unit provided to the drive source; a first coupling unit provided to the first carriage to transmit a driving force from the drive source to the first lifting/lowering unit to move the first recording head upward and downward; a second coupling unit provided to the second carriage, a first end of which coupled to the drive coupling unit to transmit the driving force from the drive source to the second lifting/lowering unit to move the second recording head upward and downward, a second end opposite the first end coupled to the first coupling unit to further transmit the driving force to the first lifting/lowering unit; a docking/separation unit that docks and separates the first and second carriages with and from each other; and an accommodation/coupling unit that couples the first coupling unit to the second end of the second coupling unit to transmit the driving force to the first lifting/lowering unit and accommodates the first coupling unit within the first carriage to uncouple the first coupling unit from the second end of the second coupling unit. Accommodation and coupling of the first coupling unit by the accommodation/coupling unit are performed in conjunction with docking and separation of the first and second carriages by the docking/separation unit.

In another illustrative embodiment, an image forming apparatus includes first carrying means movable in a main scanning direction for carrying a first recording head, first lifting/lowering means for moving the first recording head upward and downward in a direction perpendicular to a surface of a recording medium, second carrying means movable in the main scanning direction for carrying a second recording head, second lifting/lowering means for moving the second recording head upward and downward in the direction perpendicular to the surface of the recording medium, driving means for driving the first and second lifting/lowering means, drive coupling means for transmitting a driving force, first coupling means for transmitting the driving force from the driving means to the first lifting/lowering means to move the first recording head upward and downward, second coupling means for transmitting the driving force from the driving means to the second lifting/lowering means to move the second recording head upward and downward and further transmitting the driving force to the first lifting/lowering means, docking/separation means for docking and separating the first and second carrying means with and from each other, and accommodation/coupling means for coupling the first coupling means to one end of the second coupling means to transmit the driving force to the first lifting/lowering means and accommodating the first coupling means within the first carrying means to uncouple the first coupling means from the one end of the second coupling means. Accommodation and coupling of the first coupling means by the accommodation/coupling means are performed in conjunction with docking and separation of the first and second carrying means by the docking/separation means.

Additional aspects, features, and advantages of the present disclosure will be more fully apparent from the following detailed description of illustrative embodiments, the accompanying drawings, and the associated claims.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein like reference numerals designate identical or corresponding parts throughout the several views and wherein.

DETAILED DESCRIPTION OF THE ILLUSTRATIVE EMBODIMENTS

Figure 1:
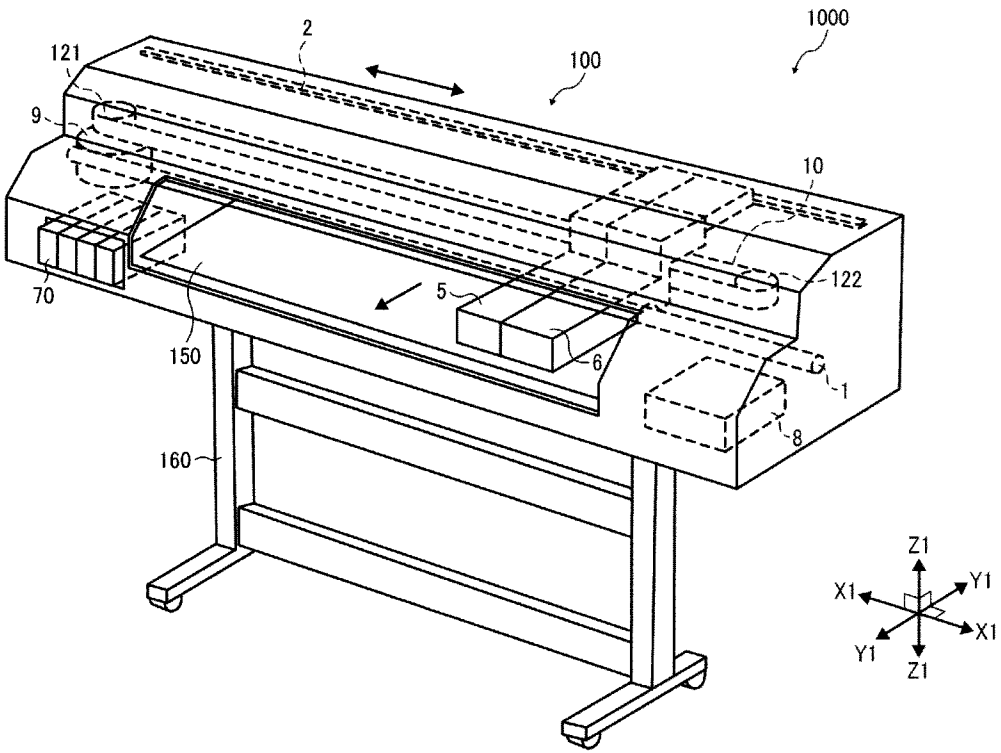
FIG. 1 is a perspective view illustrating an example of a configuration of an image forming apparatus according to illustrative embodiments.

In describing illustrative embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve a similar result.

A description is now given of a configuration and operation of an image forming apparatus 1000 according to illustrative embodiments. FIG. 1 is a perspective view illustrating an example of a configuration of the image forming apparatus 1000 according to illustrative embodiments.

The image forming apparatus 1000 is a serial-type inkjet recording device, and includes, as main components thereof, a recording device 100 and a sheet feeder. The recording device 100 employs an inkjet system in which recording heads eject liquid droplets onto a recording medium such as a sheet of paper (hereinafter referred to as a sheet 150) to form images on the sheet 150. The sheet feeder conveys the sheet 150 to the recording device 100.

Figure 2:
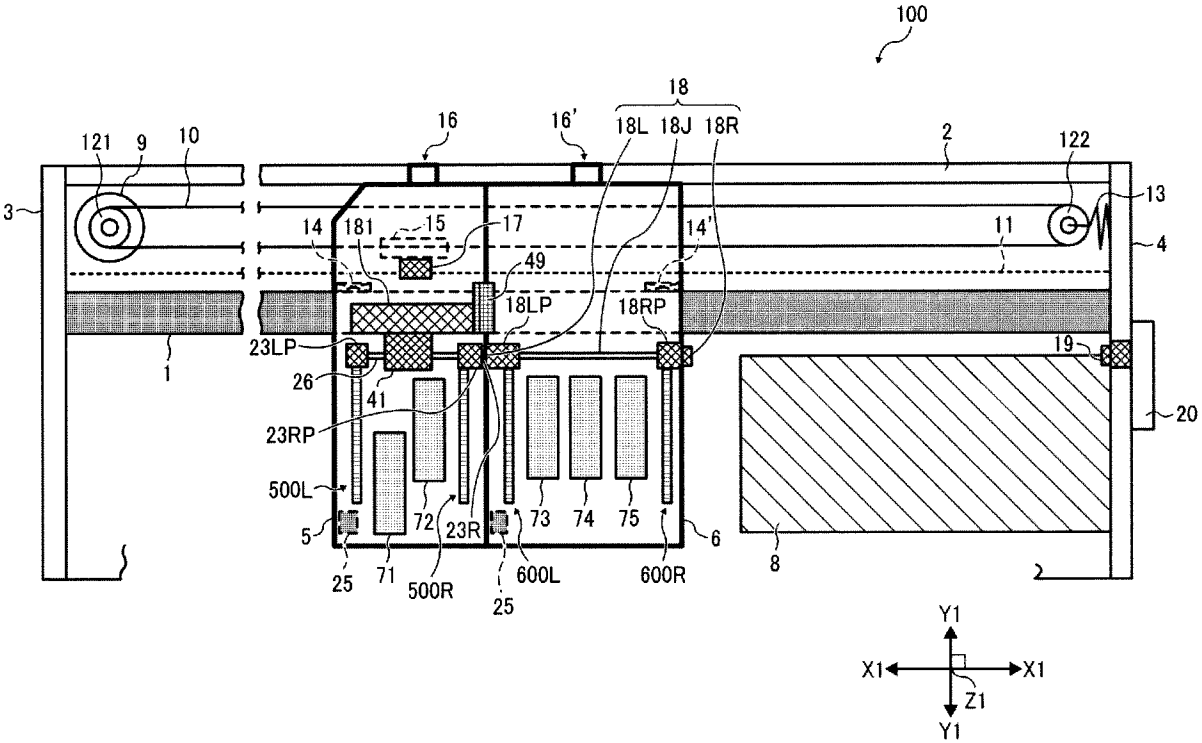
FIG. 2 is a top view illustrating an example of a configuration of a recording device in a state in which first and second carriages docked with each other are moved in a main scanning direction according to a first illustrative embodiment.

FIG. 2 is a top view illustrating an example of a configuration of the recording device 100 according to a first illustrative embodiment. Although not shown in FIGS. 1 and 2 for ease of illustration, the sheet feeder is incorporated in the recording device 100. Alternatively, the sheet feeder may be provided as a separate unit to be connected to the recording device 100. Two types of sheets 150 each having a different thickness are used as a recording medium and are selectively conveyed to the recording device 100 to form images on the sheets 150 in the first illustrative embodiment.

It is to be noted that a distance between nozzle surfaces 71*a* to 75*a* of recording heads 71 to 75 described in detail later, on the one hand, and a recording surface of the sheet 150 on the other is hereinafter referred to as a gap L. A longitudinal direction of a guide rod 1 also to be described later, along which the recording heads 71 to 75 are moved reciprocally back and forth, is hereinafter referred to as a main scanning direction X1-X1. A sub-scanning direction Y1-Y1 is perpendicular to the main scanning direction X1-X1 shown on a virtual plane surface. A direction perpendicular to the main scanning direction X1-X1 and the sub-scanning direction Y1-Y1 respectively shown on the virtual plane surface is hereinafter referred to as a vertical direction Z1-Z1. The sub-scanning direction Y1-Y1 is the same as a direction of conveyance of the sheet 150 in the recording device 100, and the vertical direction Z1-Z1 is perpendicular to the recording surface of the sheet 150. The recording heads 71 to 75 are moved upward and downward in the vertical direction Z1-Z1, and the gap L is the distance between the nozzle surfaces 71*a* to 75*a* of the recording heads 71 to 75, on the one hand, and the recording surface of the sheet 150, on the other, in the vertical direction Z1-Z1.

The image forming apparatus 1000 further includes a support stand 160 that supports the recording device 100. The recording device 100 includes the cylindrical guide rod 1 and a sub-guide 2, each extended between a left lateral plate 3 and a right lateral plate 4. The recording device 100 further includes a first carriage 5 that ejects black ink droplets and a second carriage 6 that ejects color ink droplets. The first carriage 5 alone or the first and second carriages 5 and 6 docked with each other is/are moved reciprocally in the main scanning direction X1-X1 within the recording device 100. The first and second carriages 5 and 6 are driven to eject the ink droplets of the respective colors based on image data while the sheet 150 is intermittently conveyed in the sub-scanning direction Y1-Y1 to form desired images on the sheet 150.

The first carriage 5 has a bearing 14 that slides against the guide rod 1 at both ends thereof in the main scanning direction X1-X1 to be moved reciprocally back and forth in the main scanning direction X1-X1.

The second carriage 6 is not movable alone, and is moved together with the first carriage 5 in the main scanning direction X1-X1 when docked with the first carriage 5 through a docking member 49 provided to the first carriage 5. Because provision of bearings that slide against the guide rod 1 to the second carriage 6 may prevent smooth movement of the first and second carriages 5 and 6 docked with each other due to a relation with the bearings 14 of the first carriage 5, the second carriage 6 does not have such bearings that completely engage the guide rod 1. However, because a load of the second carriage 6 is supported by the guide rod 1 while the second carriage 6 is sliding against the guide rod 1 together with the first carriage 5, a support member 14' having a plate-like shape or a shape that loosely engages the guide rod 1 is provided between the guide rod 1 and the second carriage 6.

The sub-guide 2 having a long plate-like shape is fixed between the left and right lateral plates 3 and 4, and a guide member 16 including two rollers that sandwich a flat surface of the sub-guide 2 is provided at an end of the first carriage 5 in the sub-scanning direction Y1-Y1. The bearings 14 and the guide member 16 slidably hold the first carriage 5 in the main scanning direction X1-X1. A guide member 16' corresponding to the guide member 16 of the first carriage 5 is provided at one end of the second carriage 6 in the sub-scanning direction Y1-Y1.

Figure 3:
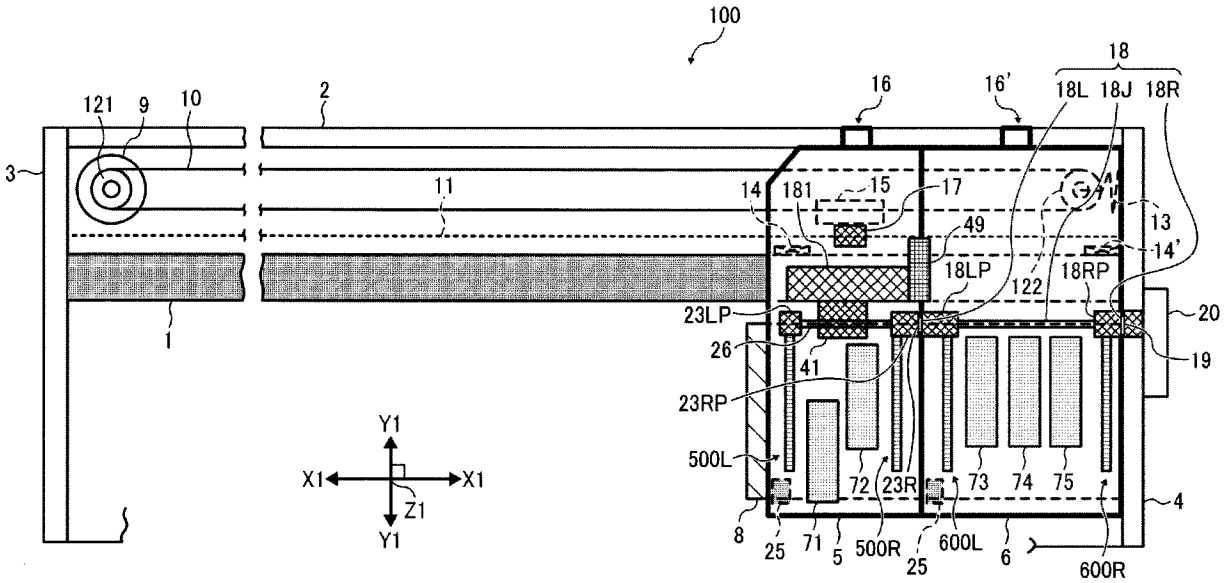
FIG. 3 is a top view illustrating another example of the configuration of the recording device in a state in which the first and second carriages are docked with each other at home positions thereof.
Figure 4:
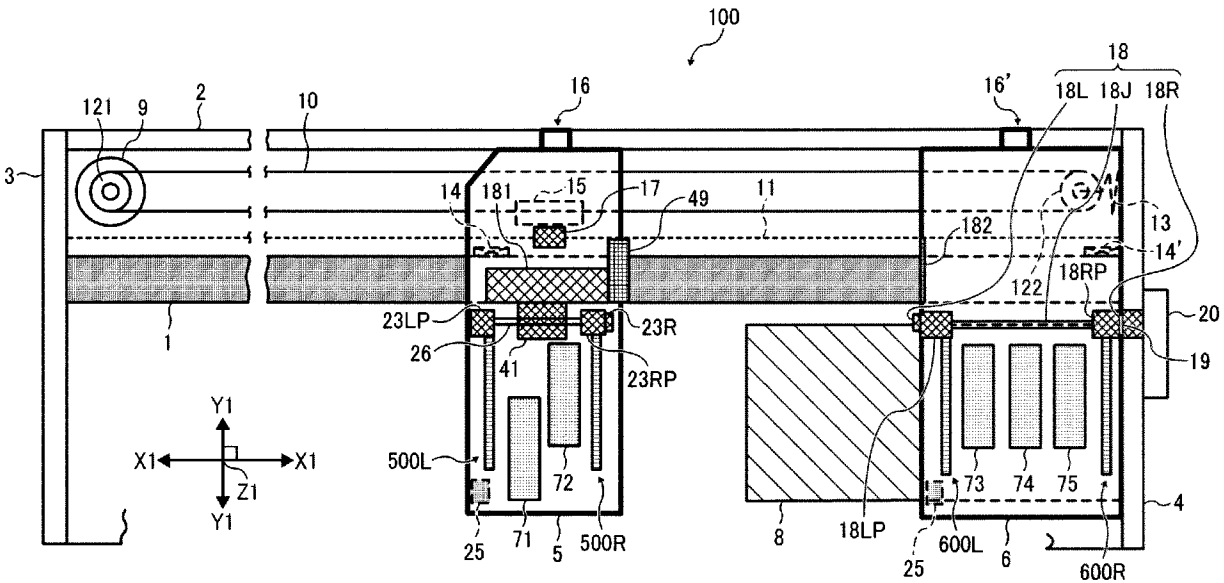
FIG. 4 is a top view illustrating yet another example of the configuration of the recording device in a state in which only the first carriage is moved while the second carriage remains at the home position thereof.
Figure 5:
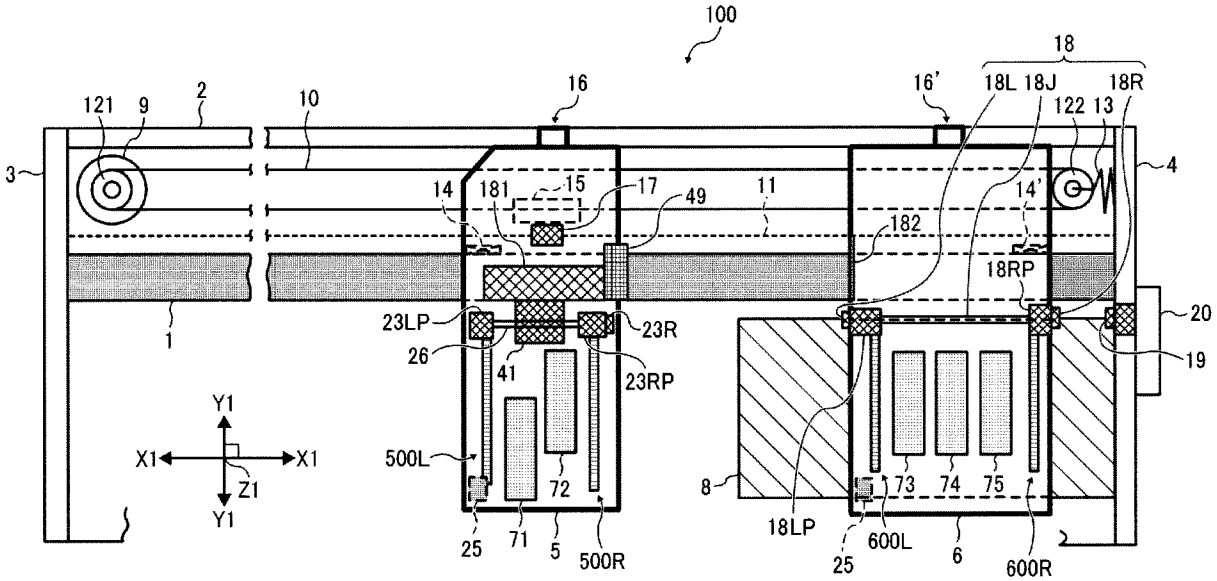
FIG. 5 is a top view illustrating still yet another example of the configuration of the recording device in a state in which the first and second carriages are separated from each other at positions away from the home positions thereof.

FIGS. 2 to 5 are top views respectively illustrating the configuration of the recording device 100 in different states. Specifically, FIG. 2 illustrates a state in which the first and second carriages 5 and 6 docked with each other by the docking member 49 are moved to a middle portion of the guide rod 1 in the main scanning direction X1-X1. The first and second carriages 5 and 6 are docked with each other to be moved together in the main scanning direction X1-X1 in order to form full-color images on the sheet 150. FIG. 3 illustrates a state in which the first and second carriages 5 and 6 docked with each other by the docking member 49 are moved to the right end of the guide rod 1 in the main scanning direction X1-X1, that is, a home position of each of the first and second carriages 5 and 6. FIG. 4 illustrates a state in which the second carriage 6 is positioned at the home position thereof and only the first carriage 5 is moved to the middle portion of the guide rod 1 in the main scanning direction X1-X1. Specifically, only the first carriage 5 is moved in the main scanning direction X1-X1 while the second carriage 6 remains at the home position thereof to form monochrome images. FIG. 5 illustrates a state in which the first and second carriages 5 and 6 are separated from each other at positions away from the home positions thereof. However, the state illustrated in FIG. 5 never happens in the recording device 100 during image formation. The purpose of FIG. 5 is, for ease of illustration, to clearly show a maintenance unit 8, a driven pulley 122, and so forth to be described in detail later, which are hidden by the first and second carriages 5 and 6 respectively positioned at the home positions thereof when viewed from the top.

A description is now given of configurations of the first and second carriages 5 and 6.

The first carriage 5 includes the first recording heads 71 and 72 each ejecting black ink droplets. The second carriage 6 includes the second recording heads 73, 74, and 75 each ejecting ink droplets of a specific color, that is, yellow (Y), magenta (M), or cyan (C). Installation positions of the first recording heads 71 and 72 are offset from each other in the main scanning direction X1-X1 and the sub-scanning direction Y1-Y1. Although not shown, a sub-tank that supplies ink to the first and second recording heads 71 to 75 is integrally formed with each of the first and second recording heads 71 and 75. Black ink is supplied to the sub-tanks of the first recording heads 71 and 72 of the first carriage 5 and ink of the specified color is supplied to the sub-tanks of the second recording heads 73 to 75 of the second carriage 6 from an ink cartridge 70 provided at one end of the image forming apparatus 1000 via tubes, not shown. Alternatively, the ink cartridge 70 may be replaceably attached to each of the first and second carriages 5 and 6.

Figure 6:
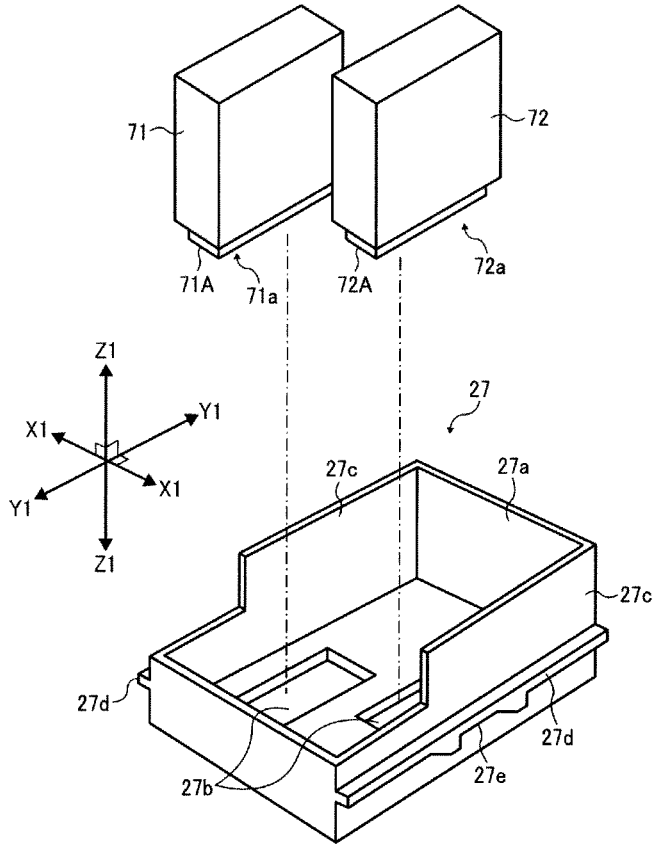
FIG. 6 is an exploded perspective view illustrating an example of a configuration of a first head holder.
Figure 7:
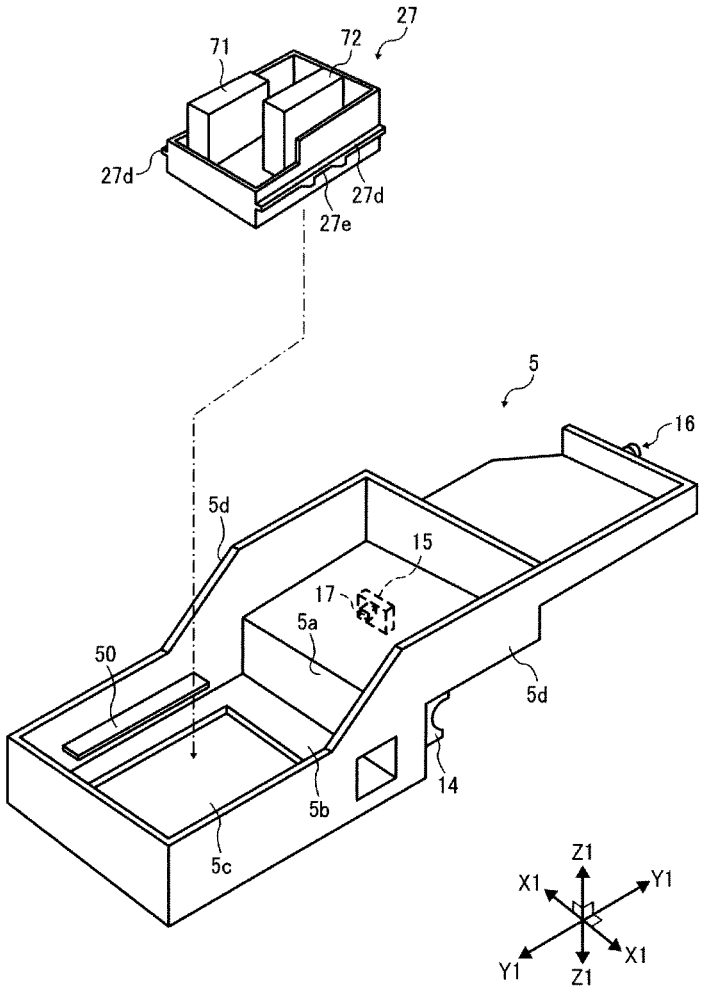
FIG. 7 is an exploded perspective view illustrating relative positions of the first head holder and a main body of the first carriage.

The first recording heads 71 and 72 are stored within a first head holder 27, and the first head holder 27 containing the first recording heads 71 and 72 is installed on the first carriage 5. FIG. 6 is an exploded perspective view illustrating an example of a configuration of the first head holder 27. FIG. 7 is an exploded perspective view illustrating relative positions of the first head holder 27 containing the first recording heads 71 and 72 and a main body of the first carriage 5.

Figure 25:
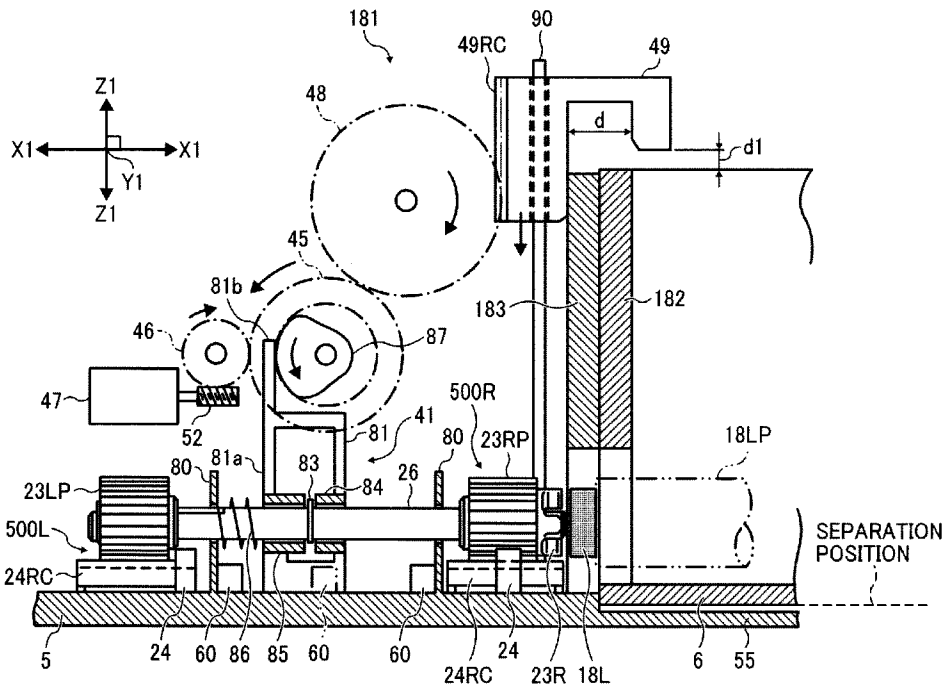
FIG. 25 is a vertical cross-sectional view illustrating relative positions of a docking member and the second carriage lifted to the separation position viewed from the front according to the second illustrative embodiment.

Similarly, the second recording heads 73 to 75 are stored within a second head holder 28 that corresponds to the first head holder 27, and the second head holder 28 containing the second recording heads 73 to 75 is installed on the second carriage 6 as illustrated in FIG. 25 to be described later. It is to be noted that the first and second head holders 27 and 28 are omitted in FIGS. 2 to 5 for ease of illustration.

A main scanning mechanism that moves the first and second carriages 5 and 6 reciprocally in the main scanning direction X1-X1 includes a main scanning motor 9 positioned at one end of the recording device 100 in the main scanning direction X1-X1, that is, the left end in FIGS. 1 to 5; a drive pulley 121 fixed to a rotary shaft of the main scanning motor 9; the driven pulley 122 positioned at the other end of the recording device 100 in the main scanning direction X1-X1, that is, the right end in FIGS. 1 to 5; and a timing belt 10 wound around the drive pulley 121 and the driven pulley 122. The driven pulley 122 is pulled outward toward the right lateral plate 4 by a spring 13 to apply tension to the timing belt 10.

A part of the timing belt 10 is fixed to a mount 15 provided on a back surface of the first carriage 5 so that the first carriage 5 is moved reciprocally in the main scanning direction X1-X1 together with the timing belt 10 by a driving force from the main scanning motor 9. The guide rod 1 and the sub-guide 2 restrict movement of the first carriage 5 such that the first carriage 5 is movable reciprocally in the main scanning direction X1-X1. The second carriage 6 is separatably dockable with the first carriage 5 by the docking member 49 to be moved reciprocally in the main scanning direction X1-X1 together with the first carriage 5.

An encoder sheet 11 is provided facing the back surface of the first carriage 5 along the main scanning direction X1-X1 in order to detect a position of the first carriage 5 in the main scanning direction X1-X1. Specifically, the encoder sheet 11 is read by a first encoder sensor 17 provided on the back surface of the first carriage 5 to detect the position of the first carriage 5 in the main scanning direction X1-X1.

The docking member 49 is movable reciprocally upward and downward in the vertical direction Z1-Z1. When lowered, the docking member 49 simultaneously grips a gripped portion 182 formed at a part of a left lateral surface of the second carriage 6 and a gripped portion 183 formed at a part of a right lateral surface of the first carriage 5 contacting the gripped portion 182 so that the first and second carriages 5 and 6 are docked with each other. When lifted, the docking member 49 releases the gripped portion 182 of the second carriage 6 to separate the second carriage 6 from the first carriage 5. The docking member 49 is vertically displaced and driven by a driving mechanism 181 provided to the first carriage 5. Accordingly, the first and second carriages 5 and 6 are docked with each other by the driving mechanism 181 and the docking member 49, and the second carriage 6 is guided by the driving force transmitted from the main scanning motor 9 to the first carriage 5 so that the first and second carriages 5 and 6 are moved together in the main scanning direction X1-X1.

The first and second carriages 5 and 6 have a main scanning range through which they scan in the main scanning direction X1-X1, and within this range is a recording range where images can be formed. The sheet 150 is intermittently conveyed to the recording range by a sheet conveyance unit, not shown, in the sub-scanning direction Y1-Y1. The maintenance mechanism 8 that performs maintenance and recovery of the first and second recording heads 71 to 75 is provided at one end of the main scanning range, that is, the home positions of the first and second carriages 5 and 6 at the right end of the recording device 100. The maintenance mechanism 8 covers and uncovers the first and second recording heads 71 to 75 with caps 77. When the maintenance mechanism 8 covers the first and second recording heads 71 to 75 with the caps 77, the first and second recording heads 71 to 75 are integrated with the main body of the recording device 100.

When separated from the first carriage 5 to move only the first carriage 5 in the main scanning direction X1-X1, the second carriage 6 is held at the home position thereof while the second recording heads 73 to 75 of the second carriage 6 are capped with the caps 77 of the maintenance mechanism 8. As a result, the second recording heads 73 to 75 of the second carriage 6 are protected in a standby state, thereby extending product life of the second recording heads 73 to 75. Further, because the second recording heads 73 to 75 of the second carriage 6 are covered with the caps 77, unnecessary consumption of color ink can be prevented during monochrome image formation.

In the recording device 100, the first and second recording heads 71 to 75 are lifted and lowered based on a thickness of the sheet 150 to keep constant the distance L between the nozzle surfaces 71*a* to 75*a* of the first and second recording heads 71 to 75, on the one hand, and the recording surface of the sheet 150 on the other. A drive source 20 used for moving the recording heads 71 to 75 upward and downward in the vertical direction Z1-Z1 is disposed on an outer surface of the right lateral plate 4, and the second carriage 6 and the first carriage 5 are positioned, in that order, from the drive source 20.

A drive joint 19 serving as a drive coupling unit is provided to a rotary shaft of the drive source 20. A second coupling assembly 18 serving as a second coupling unit includes a second right joint 18R, a second drive transmission shaft 18J, and a second left joint 18L, and is supported within the second carriage 6 along the main scanning direction X1-X1. Specifically, the second right joint 18R is provided at the right end of the second coupling assembly 18, the second left joint 18L is provided at the left end thereof, and the second right and left joints 18R and 18L are coupled to each other by the second drive transmission shaft 18J.

The second right joint 18R is coupled to the drive joint 19 when the second carriage 6 is positioned at the home position thereof, and a pinion 18RP provided coaxially with the second right joint 18R engages a rack 24RC of a second right lifting/lowering unit 600R to be described in detail later, so that a driving force is transmitted from the drive source 20 to the second right lifting/lowering unit 600R. The second right lifting/lowering unit 600R to which the driving force is transmitted moves the second head holder 28 containing the second recording heads 73 to 75 upward and downward on the second carriage 6. The second left joint 18L is integrally formed with the second right joint 18R with the second drive transmission shaft 18J disposed therebetween, and a pinion 18LP provided coaxially with the second left joint 18L engages a rack 24RC of a second left lifting/lowering unit 600L. Accordingly, the second left lifting/lowering unit 600L is driven to move the second head holder 28 containing the second recording heads 73 to 75 upward and downward on the second carriage 6. As a result, the second recording heads 73 to 75 are lifted or lowered together with the second head holder 28 to an appropriate height based on the thickness of the sheet 150 by the second right and left lifting/lowering units 600R and 600L (hereinafter collectively referred to as second lifting/lowering units 600) to adjust the gap L for image formation.

It is to be noted that the drive joint 19 and the second right joint 18R are coupled to each other only when the second carriage 6 is positioned at the home position thereof as illustrated in FIGS. 3 and 4. At the home position of the second carriage 6, the heights of the second recording heads 73 to 75 are adjusted as described above.

In order to lift and lower the first recording heads 71 and 72 stored within the first head holder 27, it is required to position the first and second carriages 5 and 6 at the home positions thereof to dock the first and second carriages 5 and 6 with each other using the docking member 49 as illustrated in FIG. 3.

The first carriage 5 further includes a first right joint 23R and a first drive transmission shaft 26 extending in the main scanning direction X1-X1. The first right joint 23R is a part of a first coupling unit, and is fixed to the right end of the first drive transmission shaft 26. A pinion 23RP is provided to an outer circumference of the first right joint 23R coaxially with the first right joint 23R. A pinion 23LP is fixed to the left end of the first drive transmission shaft 26.

The first drive transmission shaft 26 is provided with an accommodation/coupling unit 41 that moves the first drive transmission shaft 26 reciprocally in the main scanning direction X1-X1. Specifically, the accommodation/coupling unit 41 moves the first drive transmission shaft 26 to the right in the main scanning direction X1-X1 with the first and second carriages 5 and 6 are docked with each other by the docking member 49. Accordingly, the first right joint 23R of the first carriage 5 is coupled to the second left joint 18L of the second carriage 6 to transmit the driving force from the drive source 20 to the first right joint 23R, the pinion 23RP, and the pinion 23LP of the first carriage 5 through the second coupling assembly 18 of the second carriage 6.

A first right lifting/lowering unit 500R of the first carriage 5 is disposed closer to the second carriage 6 than a first left lifting/lowering unit 500L of the first carriage 5. Each of the first right and left lifting/lowering units 500R and 500L (hereinafter collectively referred to as first lifting/lowering units 500) has a rack 24RC engaging the pinions 23RP and 23LP, respectively. Accordingly, the first recording heads 71 and 72 are moved upward and downward together with the first head holder 27 on the first carriage 5 by rotation of the pinions 23RP and 23LP when the driving force is transmitted from the drive source 20, and are held at appropriate heights depending on the thickness of the sheet 150. As a result, image formation is performed with the appropriate gap L. A configuration and operation of the first lifting/lowering units 500 are to be described more in detail later.

When the first recording heads 71 and 72 are not lifted or lowered by the first lifting/lowering units 500, the accommodation/coupling unit 41 moves the first drive transmission shaft 26 to the left to retreat the first right joint 23R to a position such that the first right joint 23R is uncoupled and separated from the second left joint 18L of the second carriage 6 (hereinafter referred to as an accommodation position of the first right joint 23R). As a result, the first right joint 23R is accommodated within the first carriage 5.

It is to be noted that the second drive transmission shaft 18J does not slide within the second carriage 6, and a unit corresponding to the accommodation/coupling unit 41 of the first carriage 5 is not provided in the second carriage 6.

The purpose of provision of the accommodation/coupling unit 41 to the first carriage 5 is described in detail below.

If a pick portion of the first right joint 23R that engages a pick portion of the second left joint 18L protrudes from the first carriage 5 when the first carriage 5 is moved to the home position thereof toward the second carriage 6 positioned at the home position thereof, the pick portions of the joints 23R and 18L engage with each other even under the condition in which the first and second carriages 5 and 6 are not yet docked with each other by the docking member 49. Consequently, accuracy in the relative positions of the first and second carriages 5 and 6 is decreased, thereby degrading image quality.

To solve the above-described problem, the first right joint 23R is moved to the right to a coupling position in the main scanning direction X1-X1 by the accommodation/coupling unit 41 to be coupled to the second left joint 18L after docking of the first and second carriages 5 and 6.

It is to be noted that teeth of the pinions 23RP and 23LP of the first carriage 5 and that of the racks 24RC of the first lifting/lowering units 500 engaging the pinions 23RP and 23LP are parallel to the main scanning direction X1-X1. Accordingly, coupling and accommodation of the first right joint 23R performed by the accommodation/coupling unit 41 do not affect the racks 24RC that respectively engage the pinions 23RP and 23LP, thereby not adversely affecting upward and downward movement of the first recording heads 71 and 72. The configuration and operations of the accommodation/coupling unit 41 are described in more detail later.

A description is now given of transmission of the driving force from the drive source 20 to the first and second lifting/lowering units 500 and 600.

With regard to the second carriage 6, the driving force is transmitted from the drive source 20 to the second lifting/lowering units 600 through the drive joint 19, the second right joint 18R, and the second left joint 18L, so that the second lifting/lowering units 600 are driven to lift or lower the second head holder 28 containing the second recording heads 73 to 75 on the second carriage 6. As a result, the second recording heads 73 to 75 are held at the appropriate heights depending on the thickness of the sheet 150 to reliably form images on the sheet 150.

With regard to the first carriage 5, the second left joint 18L of the second carriage 6 and the first right joint 23R of the first carriage 5 are coupled to each other so that the driving force is further transmitted from the second left joint 18L to the first right joint 23R to drive the pinions 23RP and 23LP of the first carriage 5. Accordingly, the first lifting/lowering units 500 corresponding to the pinions 23RP and 23LP, respectively, are driven to lift or lower the first head holder 27 containing the first recording heads 71 and 72 on the first carriage 5. As a result, the first recording heads 71 and 72 are held at the appropriate heights depending on the thickness of the sheet 150 to reliably form images on the sheet 150.

The first and second lifting/lowering units 500 and 600 are provided to adjust the heights of the first recording heads 71 and 72 of the first carriage 5 and the second recording heads 73 to 75 of the second carriage 6, respectively, depending on the thickness of the sheet 150. Further, the first and second carriages 5 and 6 are provided separately from each other, and docking and separation of the first and second carriages 5 and 6 are performed using the docking member 49 depending on types of image formation, that is, monochrome image formation and full-color image formation. When the first right joint 23R of the first carriage 5 and the second left joint 18L of the second carriage 6 are coupled to each other to transmit the driving force from the drive source 20 to the first lifting/lowering units 500, a force generated by coupling of the first right joint 23R and the second left joint 18L may adversely affect the relative positions of the first recording heads 71 and 72 of the first carriage 5 and the second recording heads 73 to 75 of the second carriage 6. Therefore, coupling and uncoupling of the first right joint 23R and the second left joint 18L are performed while the first and second carriages 5 and 6 are docked with each other by the docking member 49 in order to stabilize the relative positions of the first and second recording heads 71 to 75. Accordingly, timings for coupling and uncoupling the first right joint 23R to and from the second left joint 18L using the accommodation/coupling unit 41 and timings for docking and separating the second carriage 6 with and from the first carriage 5 using the docking member 49 are associated with each other. As a result, the first right joint 23R is coupled to and uncoupled from the second left joint 18L while the first and second carriages 5 and 6 are docked with each other. Further, because the driving force is transmitted from the drive source 20 to the first and second lifting units 500 and 600 when the first and second carriages 5 and 6 are docked with each other at the home positions thereof, coupling and uncoupling of the first right joint 23R to and from the second left joint 18L, docking and separation of the second carriage 6 with and from the first carriage 5, and lifting and lowering of the first and second recording heads 71 to 75 are performed while the first and second carriages 5 and 6 are positioned at the home positions thereof.

Figure 8:
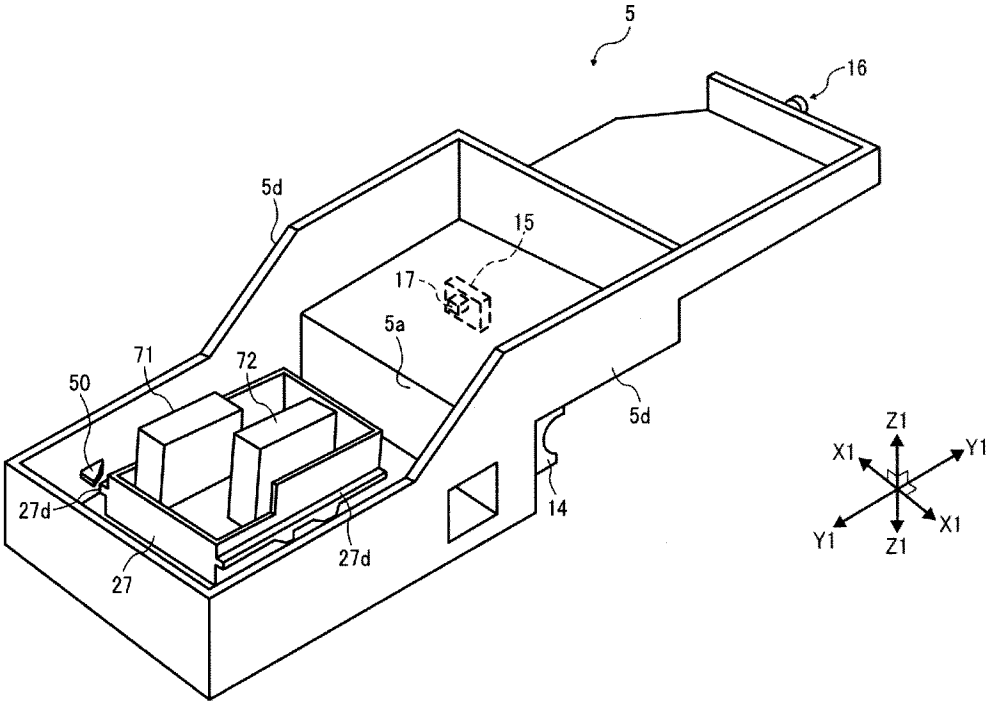
FIG. 8 is a perspective view illustrating the configuration of the first carriage mounting the first head holder.

A description is now given of mounting of the first recording heads 71 and 72 and the first head holder 27 to the first carriage 5 with reference to FIGS. 6 to 8. FIG. 8 is a perspective view illustrating the first head holder 27 containing the first recording heads 71 and 72 and installed on the first carriage 5. It is to be noted that mounting of the second head holder 28 containing the second recording heads 73 to 75 to the second carriage 6 is the same as the first carriage 5, and therefore, a description thereof is omitted.

At the bottom thereof, the first recording heads 71 and 72 respectively have rectangular protrusions 71A and 72A, each having a size smaller than the rectangular main bodies of the first recording heads 71 and 72. The first nozzle surfaces 71*a* and 72*a* are provided at the bottom of the protrusions 71A and 72A, respectively. The first head holder 27 has a box-like shape, the top of which is opened, and includes a concave first head holder storage 27*a* that stores the first recording heads 71 and 72.

The first head holder storage 27*a* has cutouts at front portions of two lateral walls 27*c* provided at both edges along the longitudinal direction thereof, that is, the sub-scanning direction Y1-Y1. Two rectangular holes 27*b* are formed at the bottom of the first head holder storage 27*a*, and the rectangular protrusions 71A and 72A are fitted into the holes 27*b*, respectively. Accordingly, the first recording heads 71 and 72 are accommodated within the first head holder storage 27*a*, and the first nozzle surfaces 71*a* and 72*a* are exposed through the holes 27*b*. Positions of the two holes 27*b* are not precisely parallel but are offset from each other in the sub-scanning direction Y1-Y1 so that a length of the recording heads 71 and 72 in the sub-scanning direction Y1-Y1 is elongated to widen the scanning range of the first recording heads 71 and 72 during image formation.

A holder protrusion 27*d* that protrudes toward the main scanning direction X1-X1 is formed on each of the two lateral walls 27*c* along the longitudinal direction of the first head holder 27, that is, the sub-scanning direction Y1-Y1. A lower surface of each of the holder protrusions 27*d* has an uneven cam surface 27*e* which is rugged in the vertical direction Z1-Z1. Functions of the cam surfaces 27*e* are described in detail later.

The first head holder 27 containing the first recording heads 71 and 72 as illustrated in FIG. 8 is lifted or lowered by the first lifting/lowering units 500 in the vertical direction Z1-Z1. Similarly, the second head holder 28 containing the second recording heads 73 to 75 is lifted or lowered in the vertical direction Z1-Z1 by the second lifting/lowering units 600.

The main body of the first carriage 5 is shaped like a rectangular box elongated in the sub-scanning direction Y1-Y1, and the top of which is opened. A step 5*a* is provided on an inner bottom surface of the first carriage 5, and a bottom range 5*b* that accommodates the first head holder 27, the accommodation/coupling unit 41, the first lifting/lowering units 500, and so forth is provided in front of the step 5*a* on the inner bottom surface of the first carriage 5.

A carriage hole 5*c* having a size to accommodate the bottom of the first head holder 27 is formed at a middle portion of the bottom range 5*b*. The bottom of the first head holder 27 is disposed to face the carriage hole 5*c*, and then the components attached to the first head holder 27 are assembled. Accordingly, the first nozzle surfaces 71*a* and 72*a* of the first recording heads 71 and 72 stored in the first head holder 27 are exposed from the carriage hole 5*c*. As described previously, the first carriage 5 further includes the bearings 14, the mount 15, and the first encoder sensor 17 that detects the positions of the first carriage 5 and the first recording heads 71 and 72 in the main scanning direction X1-X1.

Vertical movement of the first recording heads 71 and 72 and the second recording heads 73 to 75 respectively using the first and second lifting/lowering units 500 and 600 adjusts the gap L between the recording surface of the sheet 150 and the first nozzle surfaces 71*a* and 72*a* of the first recording heads 71 and 72 in the first carriage 5 and the second nozzle surfaces 73*a* to 75*a* of the second recording heads 73 to 75 in the second carriage 6 based on the thickness of the sheet 150. Accordingly, the gap L is kept constant regardless of the types of the sheet 150.

A user may visually confirm the thickness of the sheet 150 and input an amount of movement of the first and second recording heads 71 to 75 corresponding to the thickness of the sheet 150 thus confirmed from an input unit, not shown. Accordingly, the first and second lifting/lowering units 500 and 600 are driven to appropriately adjust the gap L. Alternatively, when image data sent from a personal computer is printed by the image forming apparatus 1000, the user may input the thickness of the sheet 150 into the personal computer so that the amount of movement of the first and second recording heads 71 to 75 calculated by the personal computer is sent to the image forming apparatus 1000 together with the image data to adjust the gap L. Further alternatively, a well-known technology in which the thickness of the sheet 150 is automatically measured by the image forming apparatus 1000 may be used to calculate the amount of movement of the first and second recording heads 71 to 75 based on the thickness of the sheet 150 thus measured and to adjust the gap L. In such a case, the user does not need to obtain and input the thickness of the sheet 150.

A more detailed description is now given of a configuration and operation of the first and second lifting/lowering units 500 and 600. It is to be noted that the configuration and operation of the second lifting/lowering units 600 are the same as the first lifting/lowering units 500, and therefore, a description thereof is omitted.

Each of the first lifting/lowering units 500 uses a cam mechanism having an uneven surface formed by combination of long rectangular plates and slopes. Alternatively, another cam mechanism that can move the first head holder 27 upward and downward may be used for the first lifting/lowering units 500.

Figure 9:
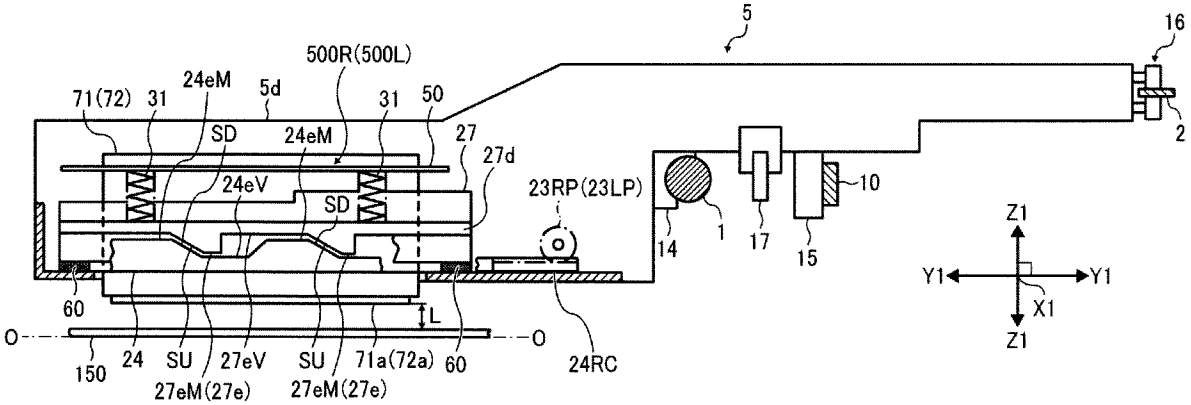
FIG. 9 is a vertical cross-sectional view illustrating the configuration of the first carriage viewed from the main scanning direction when a thin sheet is used.
Figure 10:
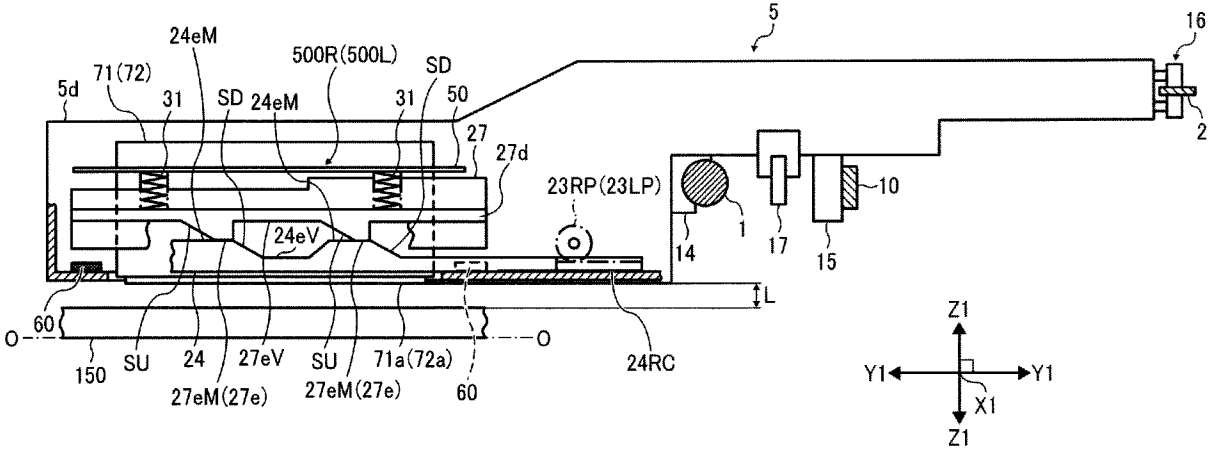
FIG. 10 is a vertical cross-sectional view illustrating the configuration of the first carriage viewed from the main scanning direction when a thick sheet is used.
Figure 11A:
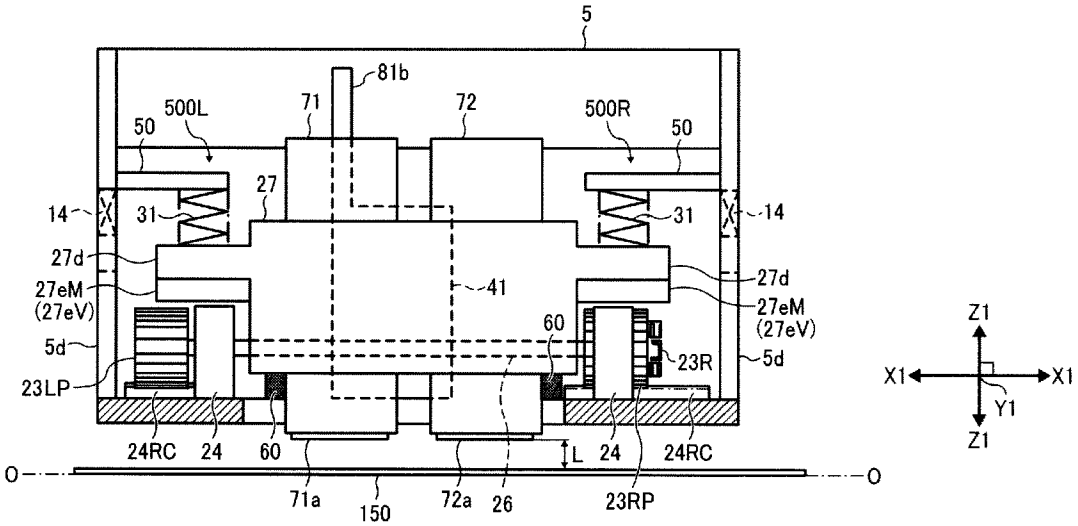
FIG. 11A is a front view illustrating the configuration of the first carriage when the thin sheet is used.
Figure 11B:
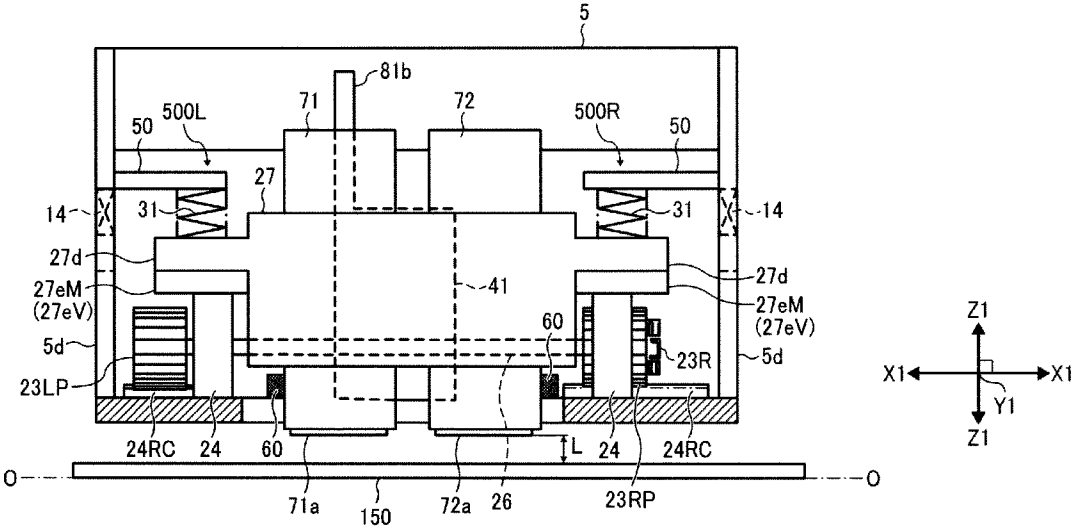
FIG. 11B is a front view illustrating the configuration of the first carriage when the thick sheet is used.
Figure 12:
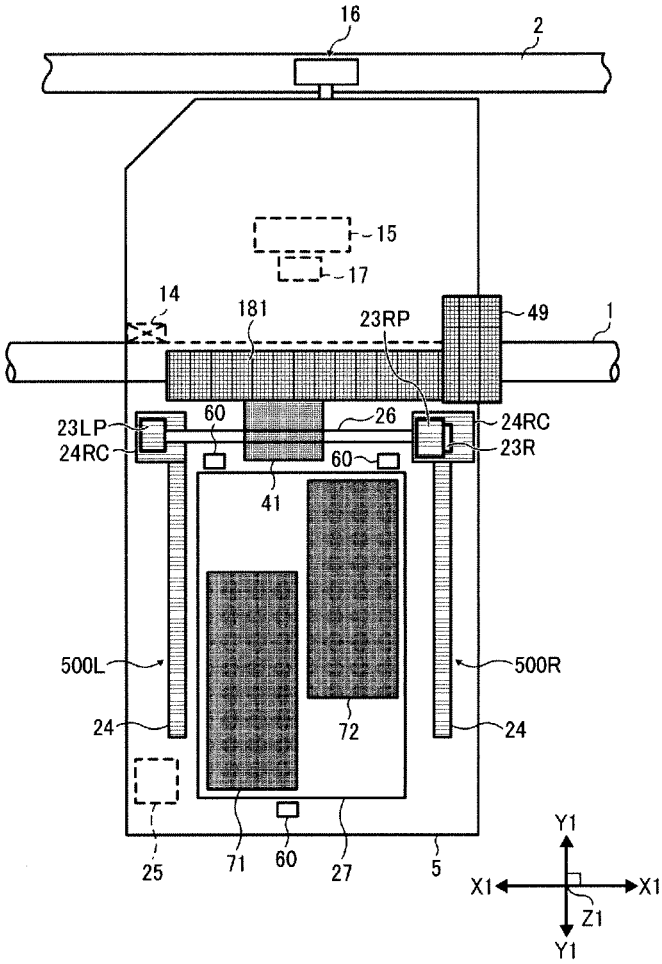
FIG. 12 is a top view illustrating the configuration of the first carriage.
Figure 13:
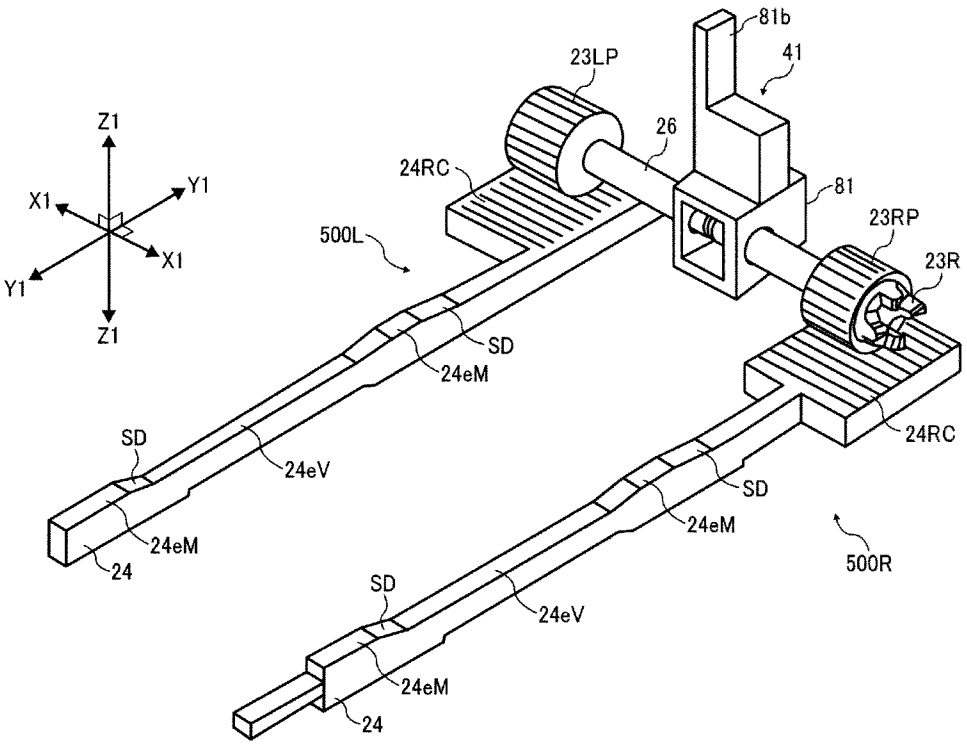
FIG. 13 is a perspective view illustrating relative positions of pinions and slide cams.
Figure 14A:
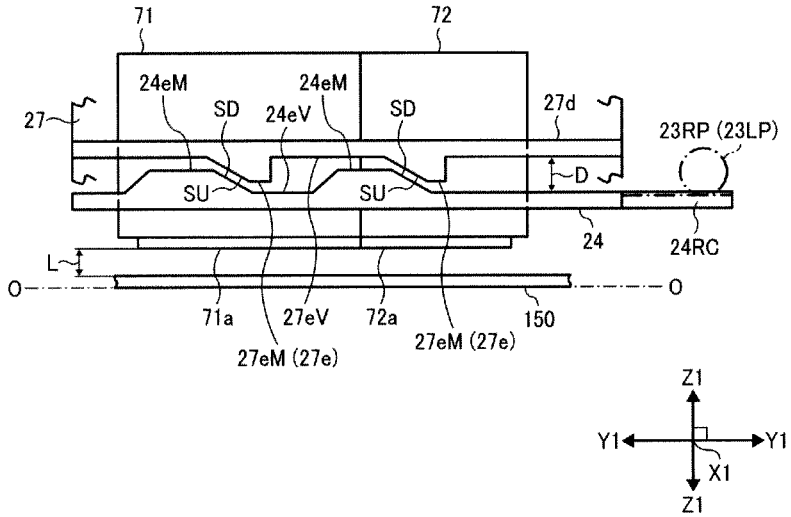
FIG. 14A is a vertical cross-sectional view illustrating relative positions of a holder protrusion and the slide cam viewed from the main scanning direction when the thin sheet is used.
Figure 14B:
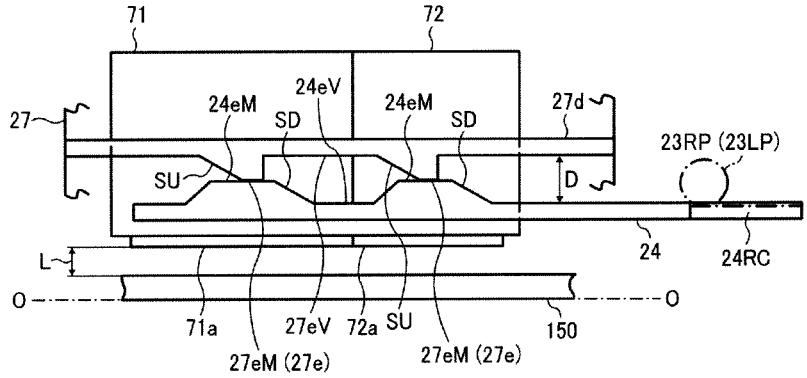
FIG. 14B is a vertical cross-sectional view illustrating relative positions of the holder protrusion and the slide cam viewed from the main scanning direction when the thick sheet is used.

FIG. 9 is a vertical cross-sectional view illustrating the configuration of the first carriage 5 viewed from the main scanning direction X1-X1 when a thin sheet 150 is used. FIG. 10 is a vertical cross-sectional view illustrating the configuration of the first carriage 5 viewed from the main scanning direction X1-X1 when a thick sheet 150 is used. FIG. 11A is a front view illustrating the configuration of the first carriage 5 when the thin sheet 150 is used. FIG. 11B is a front view illustrating the configuration of the first carriage 5 when the thick sheet 150 is used. FIG. 12 is a top view illustrating the configuration of the first carriage 5. FIG. 13 is a perspective view illustrating relative positions of the pinions 23RP and 23LP and right and left slide cams 24. FIG. 14A is a vertical cross-sectional view illustrating relative positions of the holder protrusion 27*d* and the slide cam 24 viewed from the main scanning direction X1-X1 when the thin sheet 150 is used. FIG. 14B is a vertical cross-sectional view illustrating the relative positions of the holder protrusion 27*d* and the slide cam 24 viewed from the main scanning direction X1-X1 when the thick sheet 150 is used.

The first carriage 5 has lateral walls 5*d* facing each other at both ends thereof in the main scanning direction X1-X1. Each of the lateral walls 5*d* extends in the longitudinal direction of the first carriage 5, that is, the sub-scanning direction Y1-Y1. A convex screw holding part 50 is formed on each of the lateral walls 5*d* along the longitudinal direction of the first carriage 5.

A guide member, not shown, that guides the first head holder 27 only to the vertical direction Z1-Z1 and restricts movement of the first head holder 27 in the main scanning direction X1-X1 and the sub-scanning direction Y1-Y1 is provided close to the four outer surfaces of the first head holder 27, or provided to slidably contact the four outer surfaces of the first head holder 27.

The cam surface 27*e* is formed on the lower surface of the holder protrusion 27*d* provided on each of the lateral walls 27*c* of the first head holder 27. The cam surface 27*e* has multiple convexities 27*e*M protruding downward, slopes SU, and a concave portion 27*e*V to form a cam. The top of the convexities 27*e*M and the bottom of the concave portion 27*e*V have a flat surface parallel to a virtual plane surface of X1-Y1 of orthogonal coordinates.

The right and left slide cams 24 are provided parallel to each other in the bottom range 5*b* of the first carriage 5 below the holder protrusions 27*d* and facing the holder protrusions 27*d*, respectively. The two slide cams 24 are guided by rails, not shown, in the sub-scanning direction Y1-Y1 to be moved reciprocally in the longitudinal direction of the first carriage 5, that is, the sub-scanning direction Y1-Y1. The right and left slide cams 24 are disposed perpendicular to the first drive transmission shaft 26 in the first carriage 5. The rack 24RC provided to one end of the right slide cam 24 engages the pinion 23RP, and the rack 24RC provided to one end of the left slide cam 24 engages the pinion 23LP. The driving force is transmitted from the drive source 20 to the first right joint 23R of the first carriage 5 as described previously so that the first right joint 23R and the first drive transmission shaft 26 are rotated together. When the first drive transmission shaft 26 is rotated, the right and left slide cams 24 are moved reciprocally back and forth in the sub-scanning direction Y1-Y1 by engagement of the racks 24RC with the pinions 23RP and 23LP, respectively.

Multiple upwardly protruding convexities 24*e*M, slopes SD, and a concave portion 24*e*V are formed on an upper surface of each of the right and left slide cams 24 facing the cam surfaces 27*e*. The tops of the convexities 24*e*M and the bottoms of the concave portion 24*e*V have a flat surface parallel to a virtual plane surface of X1-Y1 of orthogonal coordinates.

The rack 24RC having the teeth extending in the main scanning direction X1-X1 is provided on the upper surface of the rear end of each of the slide cams 24 in the sub-scanning direction Y1-Y1, that is, the end closer to the sub-guide 2. As illustrated in FIGS. 11 to 13, the rack 24RC of the first right lifting/lowering unit 500R engages the pinion 23RP coaxially provided to the first right joint 23R, and the rack 24RC of the first left lifting/lowering unit 500L engages the pinion 23LP.

As described above, the driving force is transmitted from the drive source 20 through the drive joint 19, the second right and left joints 18R and 18L of the second carriage 6, and the first right joint 23R of the first carriage 5 to rotate the pinions 23RP and 23LP. Accordingly, the first lifting/lowering units 500 are driven so that the slide cams 24 are moved together with the racks 24RC in the sub-scanning direction Y1-Y1. As a result, the relative positions of the slide cams 24 including the convexities 24*e*M and the concave portion 24*e*V and the cam surfaces 27*e* of the holder protrusions 27*d* including the convexities 27*e*M and the concave portion 27*e*V are changed to lift or lower the first head holder 27 as illustrated in FIGS. 9 and 10.

Springs 31 each serving as an elastic member to bias the first head holder 27 upward and downward in the vertical direction Z1-Z1 are provided between upper surfaces of the holder protrusions 27*d* and the spring holding parts 50. The first head holder 27 is pressed downward by elasticity of the springs 31 to be moved downward. The downward movement of the first head holder 27 is stopped when one of the following states is brought about by movement of the slide cams 24 in the sub-scanning direction Y1-Y1.

That is, when the convexities 27*e*M and the slopes SU formed on the lower surfaces of the holder protrusions 27*d* face the concave portion 24*e*V and the slopes SD formed on the slide cams 24, respectively, as illustrated in FIGS. 9 and 14A, the first head holder 27 is lowered to its lowest position. At this time, the bottom of the first head holder 27 contacts positioning members 60 provided in the bottom range 5*b* of the first carriage 5 so that the downward movement of the first head holder 27 is stopped and the first head holder 27 is securely positioned in the vertical direction Z1-Z1 while receiving the elastic force from the springs 31.

In order to securely position the first head holder 27 in the vertical direction Z1-Z1 using the positioning members 60, the first head holder 27 is positioned at a height to provide a gap D between the holder protrusions 27*d* and the slide cams 24 as illustrated in FIG. 14A such that the convexities 27*e*M and the concave portion 27*e*V of the holder protrusions 27*d* do not contact the convexities 24*e*M and the concave portion 24*e*V of the slide cams 24. The positioning member 60 is provided at three positions in the bottom range 5*b* of the first carriage 5 to contact and support the first head holder 27 at the three positions, thereby achieving secure positioning of the first head holder 27 in the vertical direction Z1-Z1.

In the above-described state, the first recording heads 71 and 72 are positioned closest to a reference surface O-O of the thin sheet 150 conveyed along the reference surface O-O such that the gap L between the first nozzle surfaces 71*a* and 72*a* of the first recording heads 71 and 72 and the recording surface of the sheet 150 is appropriately adjusted to a predetermined constant value.

Assuming that the slopes SD of the slide cams 24 and the slopes SU of the holder protrusions 27*d* contact each other without the gap D therebetween, the first head holder 27 is not securely positioned in the vertical direction Z1-Z1 at this time because of manufacturing tolerances of the slide cams 24 including the convexities 24*e*M, the slopes SD, and the concave portion 24*e*V and the holder protrusions 27*d* including the convexities 27*e*M, the slopes SU, and the concave portion 27*e*V, thereby causing a positional shift between the slide cams 24 and the holder protrusions 27*d*. Therefore, it is preferable that the convex positioning members 60 be provided in the bottom range 5*b* of the first carriage 5. Accordingly, the first head holder 27 is at a normal position when the bottom surface of the first head holder 27 and the positioning members 60 contact each other, and engagement of the slide cams 24 and the holder protrusions 27*d* at this time is in a normal state. As a result, any error in the dimensions of the gap L caused by accumulation of tolerances of the components can be minimized. It is preferable that the positioning members 60 be provided to the second head holder 28 of the second carriage 6 for the same reason.

The downward movement of the first head holder 27 is also stopped when the convexities 27*e*M of the holder protrusions 27*d* contact the convexities 24*e*M of the slide cams 24 as illustrated in FIGS. 10 and 14B. When the slide cams 24 are moved to the right in FIGS. 9 and 14A in the sub-scanning direction Y1-Y1 from the normal state described above, the slopes SU and SD slide against each other so that the first head holder 27 is lifted along the slopes SD. Movement of the slides cam 24 is stopped when the convexities 27*e*M and the convexities 24*e*M contact each other as illustrated in FIGS. 10 and 14B.

In other words, the first head holder 27 containing the first recording heads 71 and 72 is lifted from the normal position to be further separated from the reference surface O-O of the sheet 150. Because the convexities 24*e*M and the convexities 27*e*M each having the flat top contact each other, even slight movement of the slide cams 24 does not affect the heights of the first recording heads 71 and 72. At this time, the first recording heads 71 and 72 are positioned at their highest positions to handle the thick sheet 150 conveyed along the reference surface O-O such that the gap L between the first nozzle surfaces 71*a* and 72*a* of the first recording heads 71 and 72 and the recording surface of the sheet 150 is adjusted to the predetermined constant value.

Reverse driving of the drive source 20 returns the first head holder 27 from its highest position to the normal position. The slide cams 24 are moved by an equal amount parallel to each other in the sub-scanning direction Y1-Y1 by rotation of the pinions 23RP and 23LP to lift or lower the first head holder 27 while horizontally holding the first head holder 27. The direction in which the slide cams 24 move can be changed by switching a direction of rotation of the drive source 20, thereby lifting or lowering the first head holder 27.

The first head holder 27 is pressed downward by the springs 31 also to prevent movement and vibration of the first head holder 27 caused by vibration of the first carriage 5. A sensor 25 provided to the first carriage 5 detects whether the first head holder 27 is positioned at the height corresponding to the thin sheet 150 or the thick sheet 150. The sensor 25 is also provided to the second carriage 6.

Figure 15:
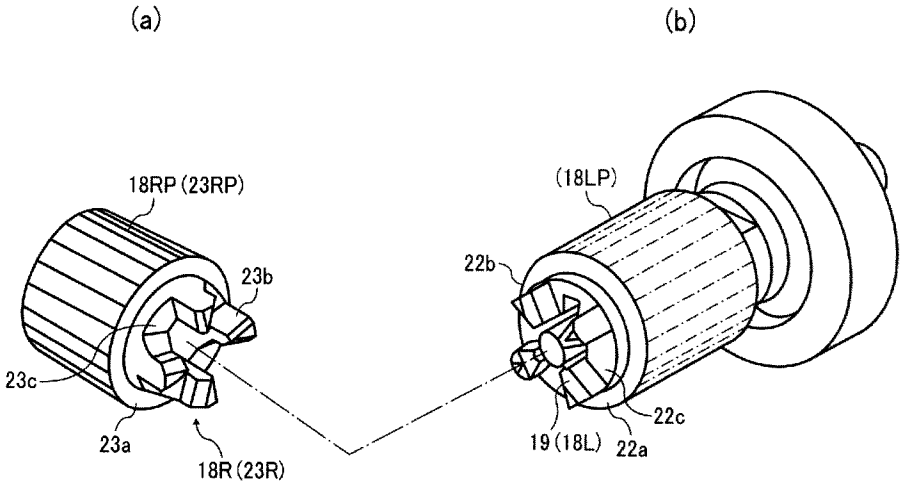
FIGS. 15(*a*) and 15(*b*) are perspective views illustrating an example of a configuration of a coupling section in the recording device.

A description is now given of a configuration and operation of a coupling section that transmits the driving force from the drive source 20 to the first right joint 23R of the first carriage 5 with reference to FIGS. 15(*a*) and 15(*b*). FIGS. 15(*a*) and 15(*b*) are perspective views illustrating a coupling section including the drive joint 19, the second right joint 18R, and the pinion 18RP of the second carriage 6, or the second left joint 18L of the second carriage 6, the first right joint 23R, and the pinion 23RP of the first carriage 5.

The example illustrated in FIG. 15(*a*) is applicable to the second right joint 18R and the pinion 18RP coaxially provided to the second right joint 18R of the second carriage 6, or the first right joint 23R and the pinion 23RP coaxially provided to the first right joint 23R of the first carriage 5.

The example illustrated in FIG. 15(*b*) is applicable to the drive joint 19, or the second left joint 18L and the pinion 18LP coaxially provided to the second left joint 18L of the second carriage 6.

As illustrated in FIG. 15(*a*), each of the second right joint 18R and the first right joint 23R has a circular edge surface 23*a*, and four convexities 23*b* are formed on the circular edge surface 23*a* in a direction of rotation of the first and second right joints 23R and 18R. Concavities 23*c* are provided between the convexities 23*b*. As illustrated in FIG. 15(*b*), each of the drive joint 19 and the second left joint 18L has a circular edge surface 22*a*, and four convexities 22*b* are formed on the circular edge surface 22*a* in a direction of rotation of the drive joint 19 and the second left joint 18L. Concavities 22*c* are provided between the convexities 22*b*.

When the two joints, that is, the second right joint 18R and the drive joint 19, or the first right joint 23R and the second left joint 18L, are coaxially moved to be coupled to each other, the four convexities 23*b* and the four convexities 22*b* engage the four concavities 22*c* and the four concavities 23*c*, respectively. Accordingly, the drive joint 19, the second right joint 18R and the pinion 18RP of the second carriage 6, or the second left joint 18L and the pinion 18LP of the second carriage 6 and the first right joint 23R and the pinion 23RP of the first carriage 5, are rotated together.

With regard to the example illustrated in FIG. 15(*b*), a pinion is not formed on the drive joint 19 because a rack to be directly driven by such a pinion formed on the drive joint 19 is not provided. In addition, it is to be noted that shapes of the joints illustrated in FIGS. 15(*a*) and 15(*b*) are not limited thereto as long as a driving force is transmitted from one joint to the other by coupling the joints to each other.

In order to adjust the heights of the first recording heads 71 and 72 depending on the thickness of the sheet 150, it is necessary to transmit the driving force from the drive source 20 to the first right joint 23R of the first carriage 5 as described above to drive the first lifting/lowering units 500 by rotation of the pinions 23RP and 23LP. Therefore, the second carriage 6 needs to be moved to the home position thereof in advance as illustrated in FIGS. 3 and 4 to couple the second right joint 18R of the second carriage 6 to the drive joint 19 while the second carriage 6 is kept at the home position thereof by the maintenance mechanism 8.

When the second carriage 6 is already docked with the first carriage 5 by the docking member 49 and the second left joint 18L of the second carriage 6 is already coupled to the first right joint 23R of the first carriage 5 as illustrated in FIG. 3 after full-color image formation, the driving force is transmitted to the first right joint 23R by driving the drive source 20. Accordingly, the first recording heads 71 and 72 can be lifted or lowered by the first lifting/lowering units 500.

However, when only the second carriage 6 is positioned at the home position thereof as illustrated in FIG. 4 after monochrome image formation, first, the first right joint 23R of the first carriage 5 is moved to the left in the main scanning direction X1-X1 by the accommodation/coupling unit 41. Accordingly, the first right joint 23R is retreated to the accommodation position and is accommodated within the first carriage 5 such that the first right joint 23R and the second left joint 18L of the second carriage 6 are not coupled to each other before docking of the first and second carriages 5 and 6.

Subsequently, the first carriage 5 is moved toward the second carriage 6 to be docked with the second carriage 6 by the docking member 49 in advance in order to prevent coupling of the second left joint 18L of the second carriage 6 and the first right joint 23R of the first carriage 5 from adversely affecting the positional accuracy of the first and second recording heads 71 to 75. After docking of the first and second carriages 5 and 6, the first right joint 23R is moved to the right to the coupling position in the main scanning direction X1-X1 by the accommodation/coupling unit 41 so that the first right joint 23R and the second left joint 18L are coupled to each other.

Further, when monochrome images are to be formed after full-color image formation, first, the first right joint 23R is moved to the left in the main scanning direction X1-X1 by the accommodation/coupling unit 41 before the first and second carriages 5 and 6 are separated from each other. Accordingly, the first right joint 23R is retreated to the accommodation position to be uncoupled from the second left joint 18L. Thereafter, the docking member 49 is released from the second carriage 6 to separate the first and second carriages 5 and 6 from each other.

Because the first carriage 5 does not have a drive source for the first lifting/lowering units 500, coupling and uncoupling of the first right joint 23R of the first carriage 5 and the second left joint 18L of the second carriage 6 are performed while the first and second carriages 5 and 6 are docked with each other. In addition, the accommodation/coupling unit 41 is provided to the first carriage 5 to move the first right joint 23R between the accommodation position and the coupling position in the main scanning direction X1-X1 in order to achieve higher positional accuracy of the first and second carriages 5 and 6 when docked with each other.

Figure 16:
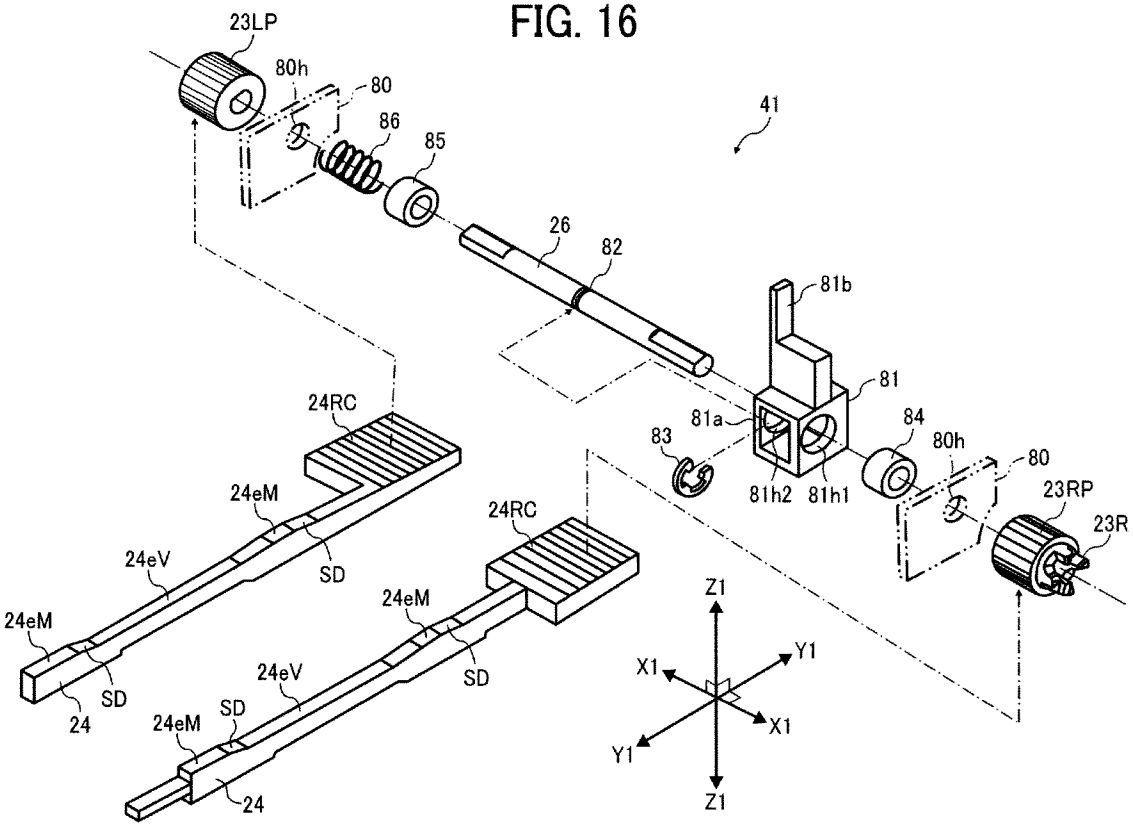
FIG. 16 is an exploded perspective view illustrating a configuration of an accommodation/coupling unit included in the first carriage.
Figure 17:
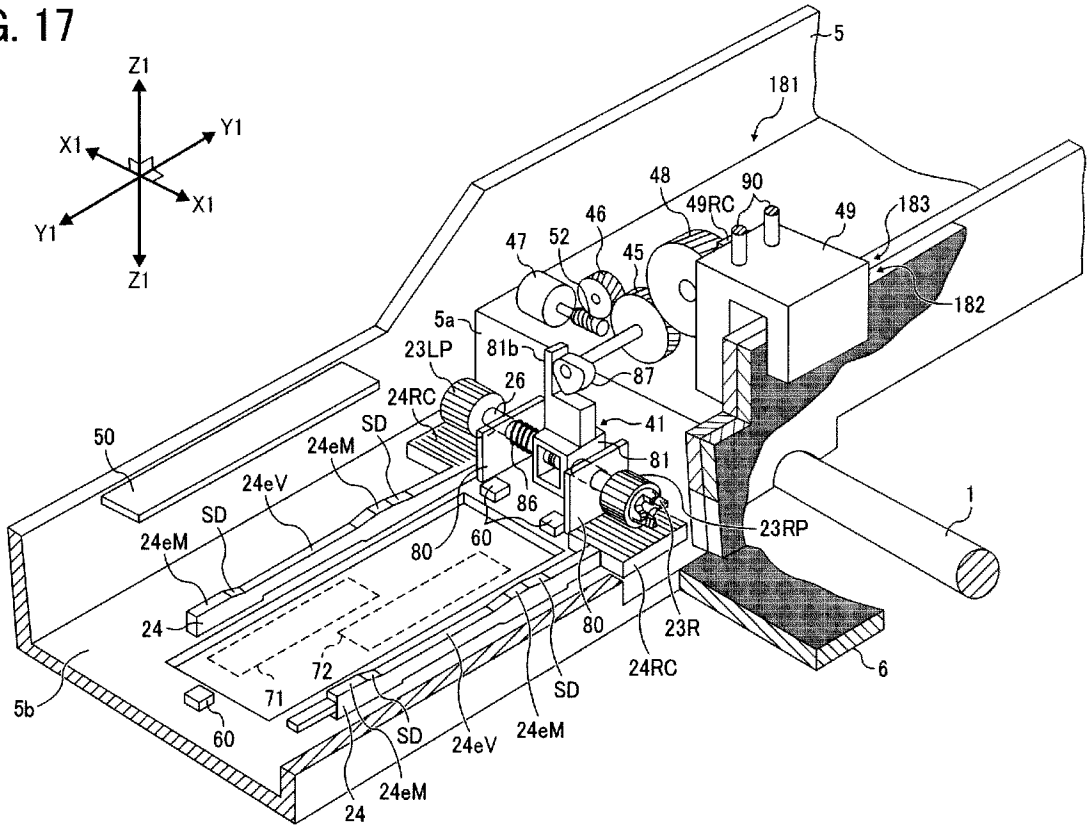
FIG. 17 is a perspective view illustrating relative positions of the accommodation/coupling unit and a docking/separation unit in the first carriage.
Figure 18:
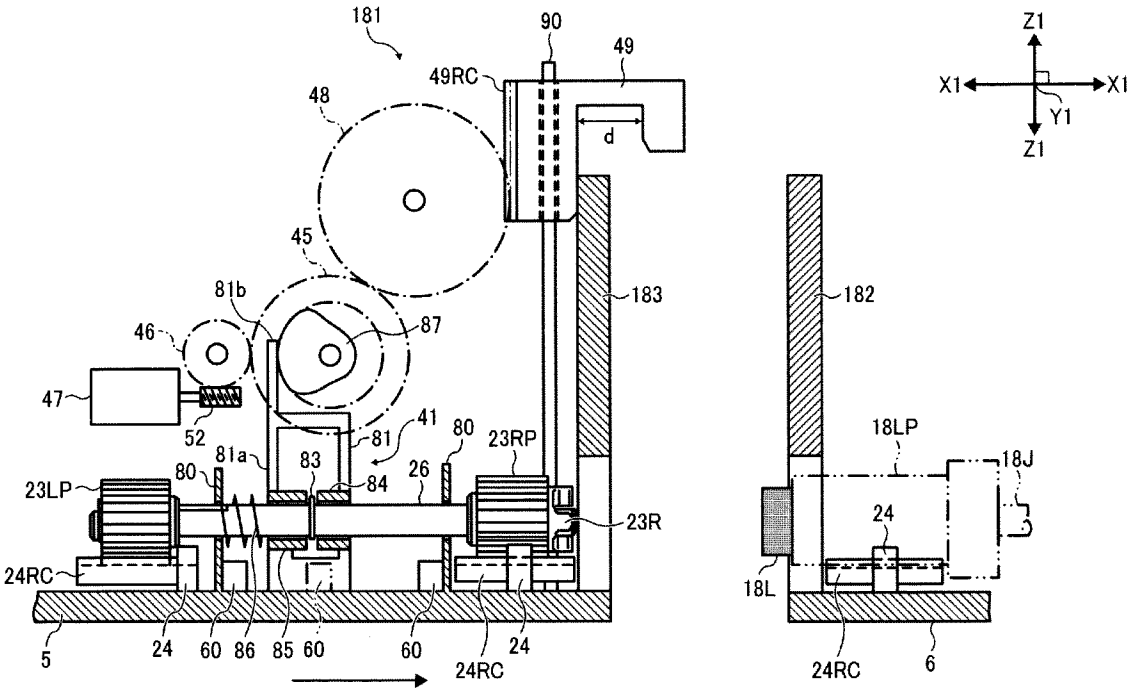
FIG. 18 is a vertical cross-sectional view illustrating the relative positions of the accommodation/coupling unit and the docking/separation unit viewed from the front.
Figure 19A:
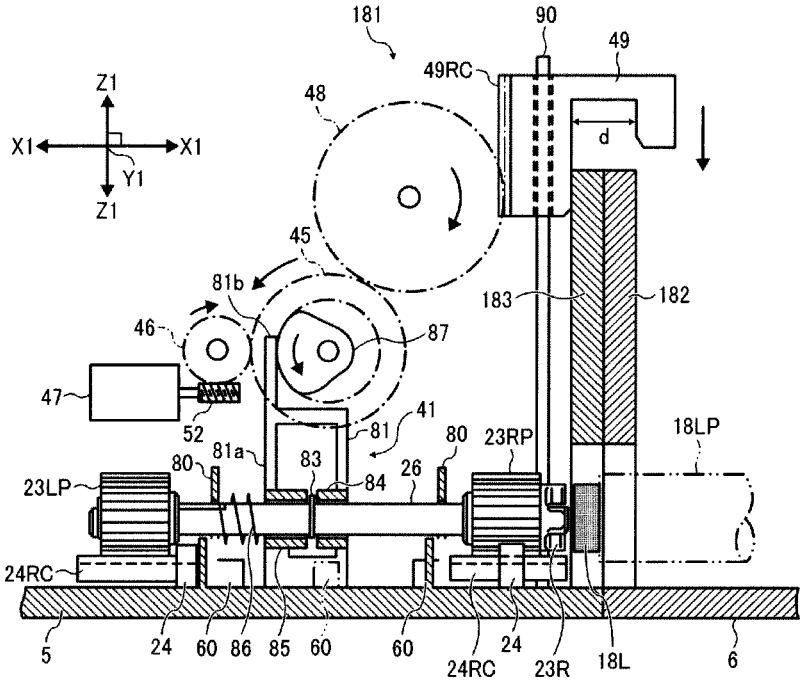
FIG. 19A is a vertical cross-sectional view illustrating an example of the configuration of the accommodation/coupling unit and the docking/separation unit viewed from the front.
Figure 19B:
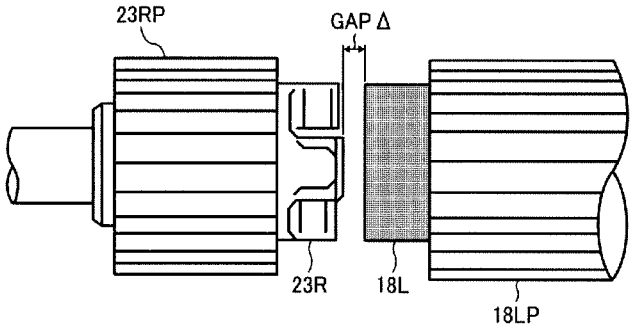
FIG. 19B is an enlarged front view illustrating relative positions of a first right joint and a second left joint under the condition illustrated in FIG. 19A.
Figure 20A:
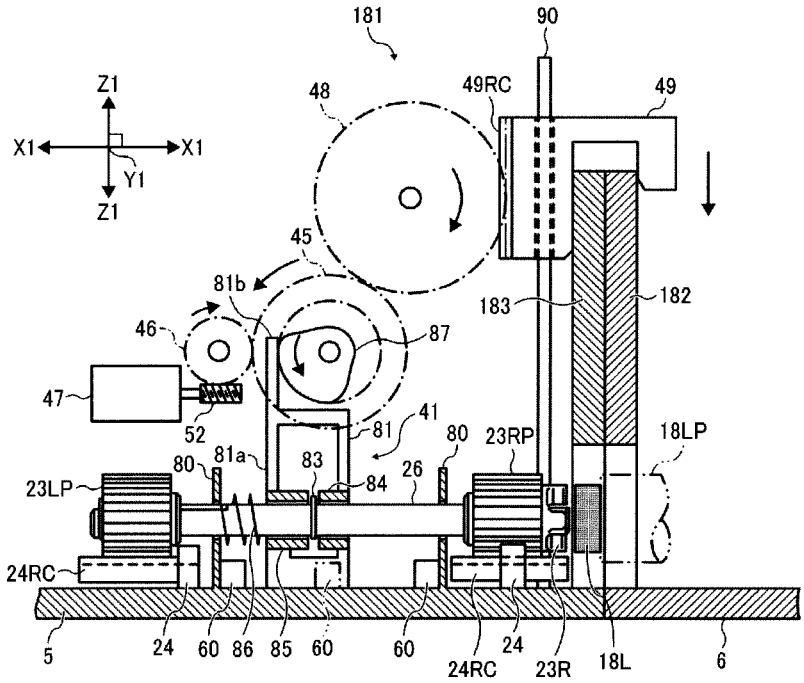
FIG. 20A is a vertical cross-sectional view illustrating another example of the configuration of the accommodation/coupling unit and the docking/separation unit viewed from the front.
Figure 20B:
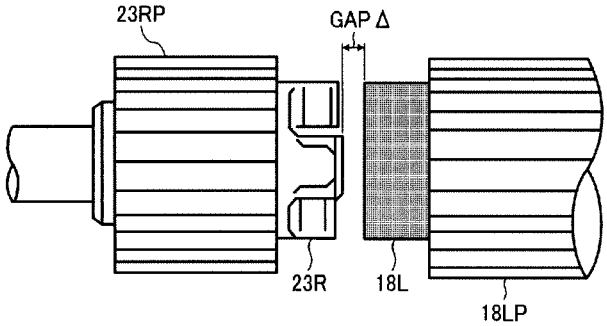
FIG. 20B is an enlarged front view illustrating relative positions of the first right joint and the second left joint under the condition illustrated in FIG. 20A.
Figure 21A:
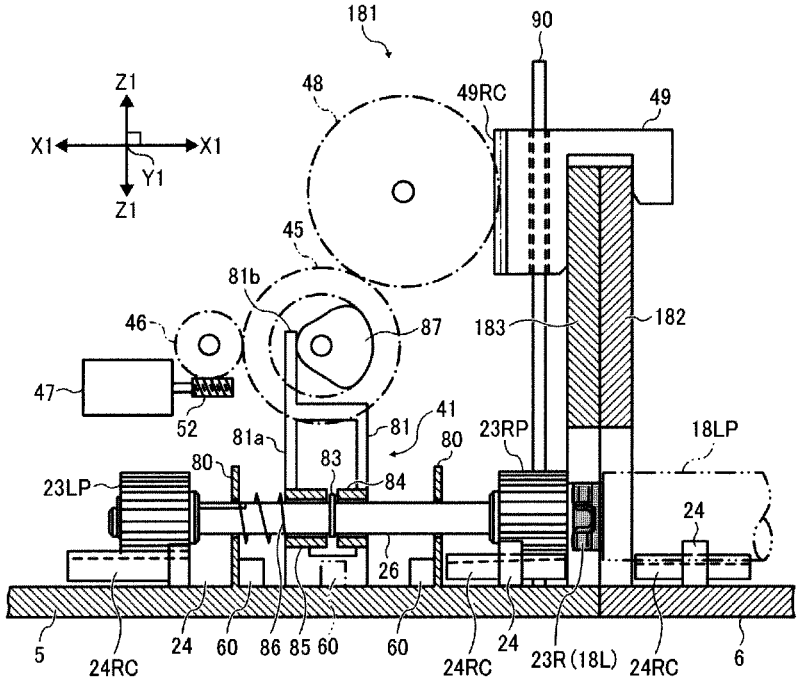
FIG. 21A is a vertical cross-sectional view illustrating yet another example of the configuration of the accommodation/coupling unit and the docking/separation unit viewed from the front.
Figure 21B:
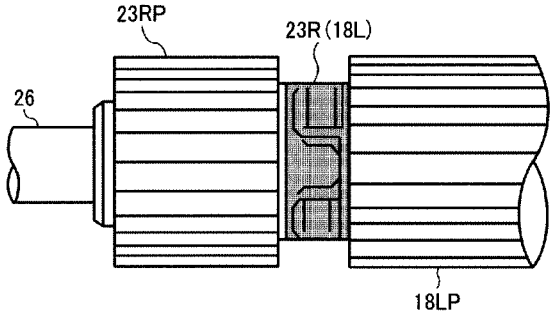
FIG. 21B is an enlarged front view illustrating relative positions of the first right joint and the second left joint under the condition illustrated in FIG. 21A.

A configuration and operation of the accommodation/coupling unit 41 are described in detail below with reference to FIGS. 16 to 21. FIG. 16 is an exploded perspective view illustrating the configuration of the accommodation/coupling unit 41. FIG. 17 is a perspective view illustrating relative positions of the accommodation/coupling unit 41 and the driving mechanism 181. FIG. 18 is a vertical cross-sectional view illustrating the relative positions of the accommodation/coupling unit 41 and the driving mechanism 181 viewed from the front. FIG. 19A is a vertical cross-sectional view illustrating an example of the configuration of the accommodation/coupling unit 41 and the driving mechanism 181 viewed from the front, and FIG. 19B is an enlarged front view illustrating the relative positions of the first right joint 23R and the second left joint 18L under the condition illustrated in FIG. 19A. FIG. 20A is a vertical cross-sectional view illustrating another example of the configuration of the accommodation/coupling unit 41 and the driving mechanism 181 viewed from the front, and FIG. 20B is an enlarged front view illustrating the relative positions of the first right joint 23R and the second left joint 18L under the condition illustrated in FIG. 20A. FIG. 21A is a vertical cross-sectional view illustrating yet another example of the configuration of the accommodation/ coupling unit 41 and the driving mechanism 181 viewed from the front, and FIG. 21B is an enlarged front view illustrating the relative positions of the first right joint 23R and the second left joint 18L coupled to each other under the condition illustrated in FIG. 21A.

The accommodation/coupling unit 41 includes the first drive transmission shaft 26 serving as a support shaft, to which the pinions 23RP and 23LP and the first right joint 23R are coaxially provided; a supporter 81 that rotatably and movably supports the first drive transmission shaft 26 in the main scanning direction X1-X1; an accommodation guide 81*b* which is a part of the supporter 81 and serves as a cam follower attached to the first drive transmission shaft 26 via the supporter 81; a coil spring 86 serving as a biasing member to bias the pinions 23RP and 23LP, the first right joint 23R, the first drive transmission shaft 26, and the accommodation guide 81*b* toward the second coupling assembly 18 of the second carriage 6; an accommodation cam 87; a motor 47 serving as an accommodation cam drive source that rotates the accommodation cam 87; and gears. The accommodation cam 87 contacts the accommodation guide 81*b* so that the first drive transmission shaft 26 is prevented from being moved by the coil spring 86 and the position of the first right joint 23R is switched between the accommodation position and the coupling position by rotation of the accommodation cam 87. Specifically, the accommodation cam 87 is rotated to move the first right joint 23R to the coupling position so that the driving force is transmitted from the drive source 20 to the first right joint 23R, or to the accommodation position so that the driving force is not transmitted from the drive source 20 to the first right joint 23R.

Two support plates 80 are provided upright on the bottom range 5*b* near the step 5*a* in the first carriage 5 to face each other over an interval interposed therebetween in the main scanning direction X1-X1. A hole 80*h* is formed in each of the support plates 80, and the first drive transmission shaft 26 is inserted into the holes 80*h*. The first right joint 23R having the pinion 23RP is fixed to one end of the first drive transmission shaft 26 protruding outward from the support plate 80 through the hole 80*h* provided closer to the second carriage 6. The pinion 23LP is fixed to the other end of the first drive transmission shaft 26 protruding outward from the support plate 80 through the hole 80*h* provided farther from the second carriage 6.

The first drive transmission shaft 26 passes through the supporter 81 composed of a housing at a middle portion between the two support plates 80. A groove 82 is formed at a middle portion of the first drive transmission shaft 26 passing through the supporter 81, and an E-ring 83 is attached to the groove 82. A first positioning collar 84 slidably engages the first drive transmission shaft 26 inside the supporter 81 at a position closer to the pinion 23RP than the E-ring 83. One end of the first positioning collar 84 contacts the E-ring 83, and the other end thereof is pressed into an insertion hole 81*h*1 formed on the supporter 81.

A second positioning collar 85 engages the first drive transmission shaft 26 inside the supporter 81 at a position closer to the pinion 23LP than the E-ring 83. One end of the second positioning collar 85 contacts the E-ring 83, and the other end thereof is pressed into an insertion hole 81*h*2 formed on the supporter 81. Accordingly, the first drive transmission shaft 26 and the supporter 81 are constituted as an integrated unit.

The supporter 81 is movable reciprocally in the main scanning direction X1-X1 together with the first drive transmission shaft 26 while positioned at the middle portion between the two support plates 80. A stroke of the supporter 81 is large enough to couple the first right joint 23R of the first carriage 5 to the second left joint 18L of the second carriage 6, or to uncouple the first right joint 23R from the second left joint 18L so that the first right joint 23R is accommodated within the first carriage 5.

The coil spring 86 wound around the first drive transmission shaft 26 is provided between the support plate 80 and the other end of the second positioning collar 85 or a wall 81*a* of the supporter 81 onto which the second positioning collar 85 is fixed. As described previously, the coil spring 86 presses the first drive transmission shaft 26, the supporter 81, the pinions 23RP and 23LP, and the first right joint 23R together toward the second carriage 6 to move them toward the second carriage 6 in the main scanning direction X1-X1.

The above-described movement of the first drive transmission shaft 26 and so forth is stopped when the accommodation guide 81*b* integrally provided to the supporter 81 contacts a cam surface of the disk-shaped accommodation cam 87. At this time, the pinions 23RP and 23LP engage the respective racks 24RC.

A rotary shaft of the accommodation cam 87 extends in the main scanning direction X1-X1, and the accommodation cam 87 is shaped like an irregular disk having a larger convexity provided farther from the rotary shaft and a smaller convexity provided closer to the rotary shaft. The accommodation cam 87 is rotated so that the pinions 23RP and 23LP are moved in the main scanning direction X1-X1, that is, the direction of the teeth of the racks 24RC, while the pinions 23RP and 23LP engage the respective racks 24RC. As a result, the first right joint 23R is coupled to the second left joint 18L, or is uncoupled from the second left joint 18L to be accommodated within the first carriage 5.

A width of each of the racks 24RC is larger than that of the pinions 23RP and 23LP in the main scanning direction X1-X1, so that the pinions 23RP and 23LP continue to engage the racks 24RC even when moving in the main scanning direction X1-X1. In addition, because the direction of the teeth of the racks 24RC and that of the pinions 23RP and 23LP are parallel to the main scanning direction X1-X1, the racks 24RC are not moved even when the pinions 23RP and 23LP are moved in the main scanning direction X1-X1.

In FIG. 20A, a cam surface of the larger convexity of the accommodation cam 87 contacts the accommodation guide 81*b*, and the first right joint 23R of the first carriage 5 is separated from the second left joint 18L of the second carriage 6. When the accommodation cam 87 is further rotated from this condition such that a cam surface of the smaller convexity of the accommodation cam 87 contacts the accommodation guide 81*b* as illustrated in FIG. 21A, the accommodation guide 81*b* is moved to the right to approach the second carriage 6. Accordingly, the first right joint 23R is coupled to the second left joint 18L. When the accommodation cam 87 is reversely rotated from this condition illustrated in FIG. 21A, the accommodation guide 81*b* and the first right joint 23R return to the state illustrated in FIG. 20A.

A description is now given of docking and separation of the first and second carriages 5 and 6 using the docking member 49.

As illustrated in FIG. 3, the first and second carriages 5 and 6 are docked with or separated from each other at the home positions thereof using the docking member 49. The docking member 49 is a U-shaped member that grips the gripped portions 183 and 182 of the first and second carriages 5 and 6 contacting each other to dock the first and second carriage 5 and 6. The docking member 49 is removed from the gripped portions 183 and 182 of the first and second carriages 5 and 6 to separate the first and second carriage 5 and 6 from each other. Reciprocating movement of the docking member 49 in the vertical direction Z1-Z1 achieves docking and separation of the first and second carriages 5 and 6.

Both of the docking member 49 reciprocally movable between positions to dock and separate the first and second carriages 5 and 6 and the driving mechanism 181 that reciprocally moves the docking member 49 serve as a docking/separation unit. The driving mechanism 181 includes guide bars 90 each serving as a guide member that restricts the direction of reciprocating movement of the docking member 49, a rack 49RC formed on the docking member 49, a pinion 48 that rotatably engages the rack 49RC to reciprocally move the docking member 49, and the motor 47 serving as a gear drive source that rotates the pinion 48. As described above, the motor 47 is also used as the accommodation cam drive source for driving the accommodation/coupling unit 41.

The U-shaped docking member 49 faces downward in the vertical direction Z1-Z1, and is reciprocally movable in the vertical direction Z1-Z1. The two guide bars 90 slidably engage the docking member 49 to guide the docking member 49 in the vertical direction Z1-Z1. The bottom end of each of the guide bars 90 is fixed to the first carriage 5.

A surface of the gripped portion 183 of the first carriage 5 and that of the gripped portion 182 of the second carriage 6, that is, a part of the lateral surface of each of the first and second carriages 5 and 6 gripped by the docking member 49 when contacting each other, are smoothen in order to accurately adjust a thickness thereof. Accordingly, the gripped portions 183 and 182 of the first and second carriages 5 and 6 are accurately gripped by the docking member 49. A gap d formed between opposing parts of the docking member 49 to accommodate and grip the gripped portions 183 and 182 is set such that the docking member 49 slidably engage the gripped portions 183 and 182 contacting each other.

The rack 49RC is formed on a band-like portion on a back surface of the docking member 49 in the vertical direction Z1-Z1. A direction of a rotary shaft of the pinion 48 coincides with the main scanning direction X1-X1, and the pinion 48 engages the rack 49RC. The pinion 48 is normally or reversely rotated to move the docking member 49 upward or downward in the vertical direction Z1-Z1, thereby docking or separating the first and second carriages 5 and 6.

The direction of the rotary shaft of both of the accommodation cam 87 and the pinion 48 coincides with the main scanning direction X1-X1 as described above. An intermediate gear 45 is provided coaxially with the rotary shaft of the accommodation cam 87 so that docking and separation of the first and second carriages 5 and 6 using the docking member 49 is performed in conjunction with accommodation and coupling of the first right joint 23R using the accommodation cam 87 by driving the intermediate gear 45.

The intermediate gear 45 engages a worm gear 46, and the worm gear 46 engages a worm 52 directly connected to the motor 47. Accordingly, the motor 47 is used as a common drive source for performing both docking and separation of the first and second carriages 5 and 6 by the docking member 49 in conjunction with accommodation and coupling of the first right joint 23R of the first carriage 5 by the accommodation/coupling unit 41.

FIG. 18 illustrates the state in which the first carriage 5 is moved toward the second carriage 6 positioned at the home position thereof. The docking member 49 is positioned above the gripped portion 183 of the first carriage 5, and the larger convexity of the accommodation cam 87 contacts the accommodation guide 81*b*. The first right joint 23R of the first carriage 5 is retreated to the accommodation position.

When the first carriage 5 reaches the home position thereof, the gripped portion 183 of the first carriage 5 contacts the gripped portion 182 of the second carriage 6 as illustrated in FIG. 19A. Although lowered by rotation of the gears 45, 46, and 48 in directions respectively indicated in FIG. 19A when the motor 47 is driven, the docking member 49 does not yet reach a position to grip the gripped portion 182 of the second carriage 6. At this time, as illustrated in FIG. 19B, the first right joint 23R of the first carriage 5 is separated from the second left joint 18L of the second carriage 6 with a gap Δ therebetween.

FIG. 20A illustrates a state in which the docking member 49 slightly grips the gripped portions 183 and 182 but the first and second carriages 5 and 6 are not yet completely docked with each other. At this time, an end portion of the larger convexity of the accommodation cam 87 still contacts the accommodation guide 81*b*. Although the first right joint 23R is still separated from the second left joint 18L with the gap Δ therebetween as illustrated in FIG. 20B, the first right joint 23R is about to be moved to the right to the coupling position.

In the state illustrated in FIG. 21A, the docking member 49 is lowered to the position to grip the gripped portions 183 and 182 to dock the first and second carriages 5 and 6 with each other, and the smaller convexity of the accommodation cam 87 contacts the accommodation guide 81*b*. At this time, as illustrated in FIG. 21B, the first right joint 23R is coupled to the second left joint 18L.

Accordingly, the first right joint 23R of the first carriage 5 and the second left joint 18L of the second carriage 6 are coupled to each other by the accommodation/coupling unit 41 after docking of the first and second carriages 5 and 6 by the docking member 49. In other words, the driving force is transmitted from the drive source 20 to the first lifting/lowering units 500 after docking of the first and second carriages 5 and 6. The steps described above are performed in reverse order, such that the first right joint 23R is retreated to the accommodation position to be accommodated within the first carriage 5 by the accommodation/coupling unit 41. Specifically, the first right joint 23R is retreated and accommodated within the first carriage 5 while the first and second carriages 5 and 6 are docked with each other, and then the first and second carriages 5 and 6 are separated from each other. Accordingly, the position of the second carriage 6 is not affected by uncoupling of the first right joint 23R from the left joint 18L.

The relative positions of the accommodation cam 87 contacting the accommodation guide 81*b* in a direction of rotation of the accommodation cam 87 and the pinion 48 engaging the rack 49RC provided to the docking member 49 in the vertical direction Z1-Z1 are such that the first right joint 23R of the first carriage 5 and the second left joint 18L of the second carriage 6 are coupled to each other by the accommodation/coupling unit 41 after the first and second carriages 5 and 6 are docked with each other by the docking member 49.

It is preferable that the first right joint 23R and the second left joint 18L be coupled to each other after docking of the first and second carriages 5 and 6 and be uncoupled from each other before separation of the first and second carriages 5 and 6 regardless of the use of the motor 47 and the accommodation cam 87. Specifically, the positions of the first and second recording heads 71 to 75 after docking of the first and second carriages 5 and 6 are less affected when docking of the first and second carriages 5 and 6 is performed first, and then the first right joint 23R and the second left joint 18L are coupled to each other with the first and second recording heads 71 to 75 accurately positioned in advance. Further, the position of the second carriage 6 held by the maintenance mechanism 8 is less affected when the first right joint 23R and the second left joint 18L are uncoupled from each other before the first and second carriages 5 and 6 are separated from each other.

Because the accommodation/coupling unit 41 is provided to the first carriage 5, it is not required to provide a dedicated drive source to each of the first and second carriages 5 and 6 even when the first and second carriages 5 and 6 are separately provided, thereby making the image forming apparatus 1000 more compact.

Although referred to as the vertical direction in the foregoing illustrative embodiment for ease of explanation, the direction of Z1-Z1 is not limited thereto. The foregoing illustrative embodiment is applicable to the directions shown in three-dimensional coordinates indicated by X1-X1, Y1-Y1, and Z1-Z1.

A description is now given of a second illustrative embodiment of the present invention. It is to be noted that, for brevity, only the differences from the first illustrative embodiment are described below.

In the second illustrative embodiment, the first carriage 5 further has mounts 55*i* and 55*ii* (hereinafter collectively referred to as mounts 55) to place the second carriage 6 thereon upon docking of the first and second carriages 5 and 6. In addition, a separation mechanism 200 is provided at the home positions of the first and second carriages 5 and 6, that is, a moisturizing and docking/separation range in the recording device 100. The separation mechanism 200 lifts the second carriage 6 to a separation position to separate the second carriage 6 from the first carriage 5 and lowers the second carriage 6 to a docking position where the second carriage 6 is placed on the mounts 55 to be docked with the first carriage 5.

In other words, the separation mechanism 200 moves the second carriage 6 upward and downward between the separation position and the docking position in the vertical direction Z1-Z1. The separation mechanism 200 includes pin members 201 each serving as a pushing member pushed from a maintenance unit including the maintenance mechanism 8 to be moved upward and downward, and elastic members 202, which may be springs, that press the pin members 201 upward to hold the second carriage 6 at a height above the mounts 55 of the first carriage 5 such that the second carriage 6 is not placed on the first carriage 5.

Figure 22:
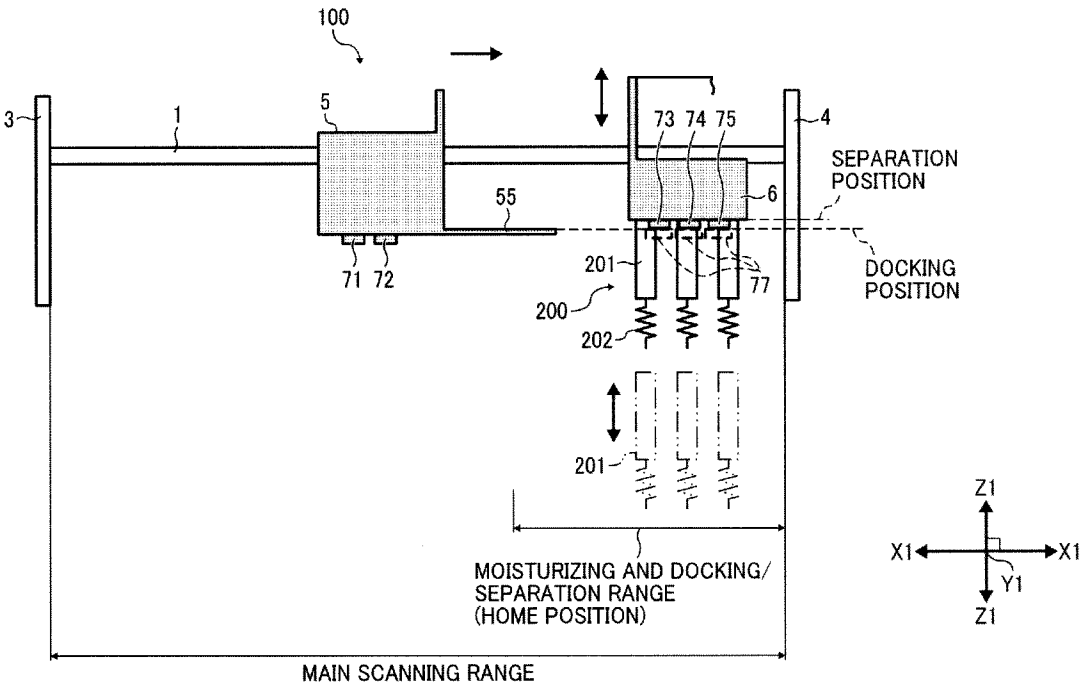
FIG. 22 is a front view illustrating an example of a configuration of a recording device according to a second illustrative embodiment.
Figure 23:
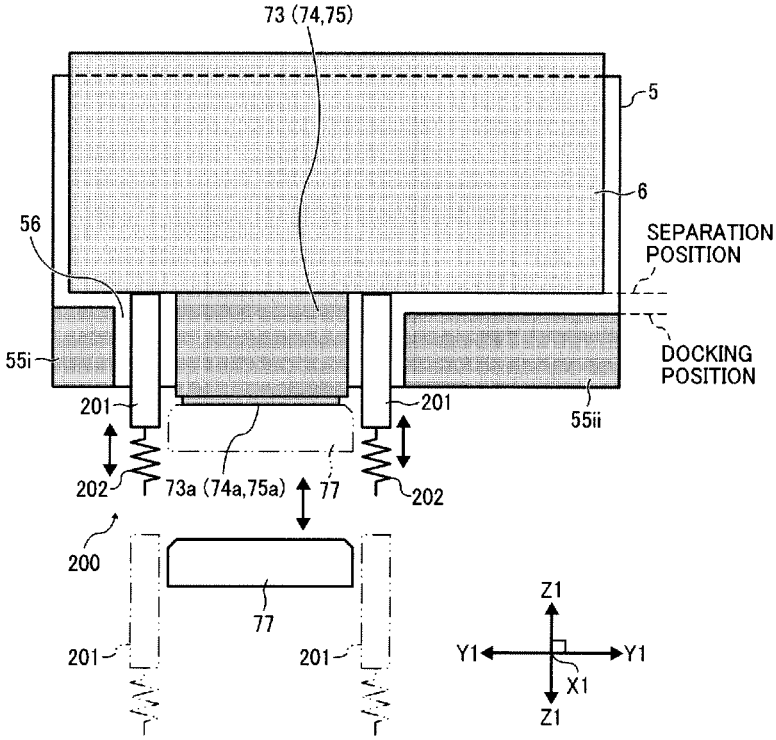
FIG. 23 is a side view illustrating a state in which the second carriage is lifted to a separation position by a separation mechanism viewed from the main scanning direction according to the second illustrative embodiment.
Figure 24:
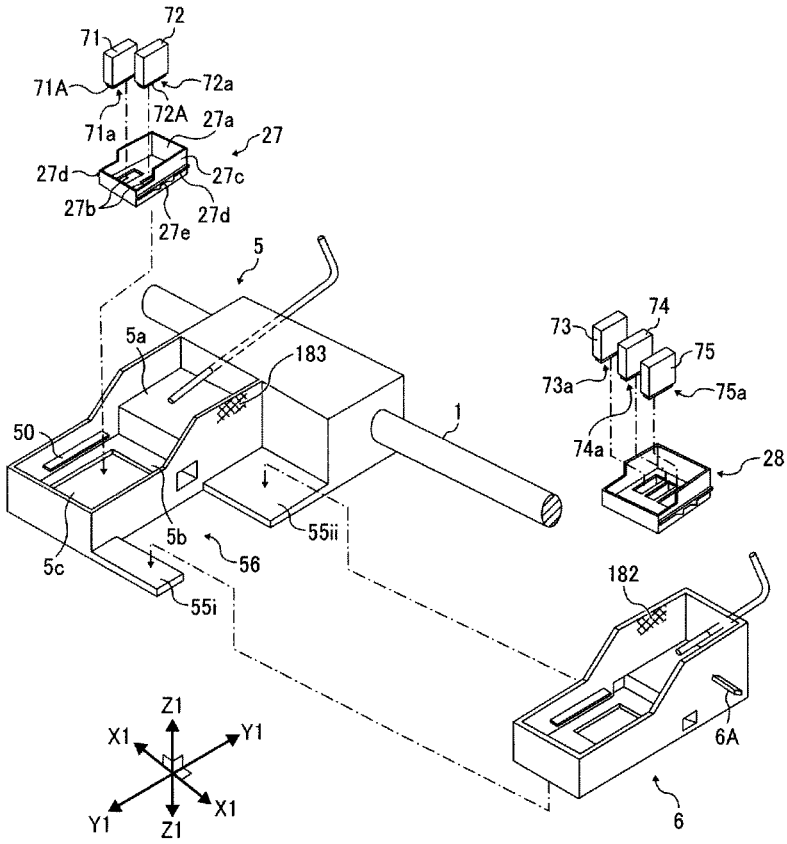
FIG. 24 is an exploded perspective view illustrating relative positions of the first and second carriages according to the second illustrative embodiment.

FIG. 22 is a front view illustrating relative position of the second carriage 6 and the separation mechanism 200 in the recording device 100 according to the second illustrative embodiment. FIG. 23 is a side view illustrating a state in which the second carriage 6 is lifted to the separation position by the separation mechanism 200 viewed from the main scanning direction X1-X1. FIG. 24 is an exploded perspective view illustrating relative positions of the first and second carriages 5 and 6 according to the second illustrative embodiment.

When the first and second carriages 5 and 6 are docked with each other, the second carriage 6 is placed on both ends of the first carriage 5, that is, the mounts 55, in the sub-scanning direction Y1-Y1. As a result, the second carriage 6 is stably placed on the first carriage 5, thereby providing reliable docking of the first and second carriages 5 and 6.

As described above, the first carriage 5 includes the two mounts 55 on which the both ends of the second carriage 6 in the sub-scanning direction Y1-Y1 are placed. A cutout 56 is formed between the mounts 55. When the second carriage 6 is placed on the mounts 55 of the first carriage 5 to be docked with the first carriage 5, the color ink droplets are ejected from the second recording heads 73, 74, and 75 of the second carriage 6 onto the sheet 150 through the cutout 56, and the caps 77 of the maintenance mechanism 8 and the pin members 201 are moved upward and downward within the cutout 56.

The second carriage 6 is moved between the docking position and the separation position in the vertical direction Z1-Z1 at the home position thereof to be docked with and separated from the first carriage 5. The second carriage 6 is lowered to the docking position to be placed on the mounts 55 of the first carriage 5 so that the second carriage 6 is docked with the first carriage 5. By contrast, the second carriage 6 is lifted to the separation position above the docking position to be separated from the first carriage 5.

The separation position is set at a height such that the second carriage 6 does not contact the mounts 55 when the first carriage 5 is moved in the main scanning direction X1-X1.

The maintenance mechanism 8 includes the caps 77 that cap the first and second recording heads 71 to 75 to cover and uncover nozzles of the first and second recording heads 71 to 75. The caps 77 are driven by the maintenance mechanism 8, and the first and second carriages 5 and 6 are positioned at the home positions thereof via the caps 77 while the first and second recording heads 71 to 75 are capped with the caps 77. At the home position, the caps 77 are vertically moved together with the vertical movement of the second carriage 6. When the first and second carriages 5 and 6 are moved in the main scanning direction X1-X1, the caps 77 are moved downward in advance to uncover the first and second recording heads 71 to 75.

A description is now given of steps in a process of docking the second carriage 6 with the first carriage 5 from the state illustrated in FIG. 22 in which the second carriage 6 is lifted to the separation position by the pin members 201 while the first carriage 5 is positioned apart from the second carriage 6 in the main scanning direction X1-X1.

First, while the second carriage 6 is lifted to the separation position by the pin members 201, the main scanning motor 9 is driven to move the first carriage 5 from the position shown in FIG. 22 to the right in the main scanning direction X1-X1 toward the home position thereof. Accordingly, the mounts 55 of the first carriage 5 are positioned below the second carriage 6, and the right lateral surface of the first carriage 5 and the left lateral surface of the second carriage 6 are positioned facing with each other.

Next, the pin members 201 are moved downward toward the maintenance mechanism 8, that is, a home position of the pin members 201, so that the second carriage 6 is moved downward from the separation position. The downward movement of the second carriage 6 is stopped at the docking position so that the second carriage 6 is placed on the mounts 55 of the first carriage 5.

As a result, the right lateral surface of the first carriage 5 and the left lateral surface of the second carriage 6 are positioned side by side in the main scanning direction X1-X1. Subsequently, the lateral surfaces of the first and second carriages 5 and 6 are gripped by the docking member 49 provided to the first carriage 5 so that the second carriage 6 is docked with the first carriage 5. Docking of the first and second carriages 5 and 6 is performed during full-color image formation. Accordingly, the first carriage 5 with which the second carriage 6 is docked by the docking member 49 is moved on the guide rod 1 in the main scanning direction X1-X1 to form full-color images.

In order to separate the second carriage 6 from the first carriage 5 for monochrome image formation, the steps described above are performed in reverse order. Specifically, first, the first and second carriages 5 and 6 docked with each other are moved to the home positions thereof where the maintenance mechanism 8 is disposed, and the docking member 49 is removed from the second carriage 6 to release docking of the first and second carriages 5 and 6. Next, the pin members 201 are pushed upward from the maintenance mechanism 8 to lift the second carriage 6 to the separation position. Accordingly, a gap is formed between the first and second carriages 5 and 6 in the vertical direction Z1-Z1 so that the second carriage 6 does not interfere with the first carriage 5. While the second carriage 6 is held at the separation position, the first carriage 5 is moved to a direction away from the right lateral plate 4 in the main scanning direction X1-X1. Accordingly, only the first carriage 5 is moved in the main scanning direction X1-X1 while the second carriage 6 is lifted by the pin members 201 to the separation position at the home position to form monochrome images.

While the first carriage 5 is moved toward the second carriage 6 positioned at the home position thereof, the second carriage 6 is lifted to the separation position such that an upper surface of the second carriage 6 does not contact a bottom surface of the docking member 49. Specifically, a gap d1 is formed between the upper surface of the second carriage 6 lifted to the separation position and the bottom surface of the docking member 49 as illustrated in FIG. 25 so that the upper surface of the second carriage 6 is not moved above the bottom surface of the docking member 49. Accordingly, the docking member 49 does not collide against the gripped portion 182 of the second carriage 6 when the first carriage 5 is moved toward the second carriage 6. Similarly, the gap d1 is provided when the first carriage 5 is separated from the second carriage 6.

During monochrome image formation, the second recording heads 73 to 75 of the second carriage 6 are covered with the caps 77 of the maintenance mechanism 8. As a result, the second recording heads 73 to 75 of the second carriage 6 are protected in a standby state, thereby extending product life of the second recording heads 73 to 75. Further, because the second recording heads 73 to 75 of the second carriage 6 are covered with the caps, unnecessary consumption of color ink can be prevented during monochrome image formation.

As described above, the cutout 56 is formed between the mounts 55 of the first carriage 5 to accommodate the second recording heads 73 to 75 of the second carriage 6 and the pin members 201 when the second carriage 6 is docked with the first carriage 5, thereby preventing collision of the first carriage 5 against the pin members 201 and so forth.

In the second illustrative embodiments, docking and separation of the first and second carriages 5 and 6 are performed in a direction other than the main scanning direction X1-X1, that is, the vertical direction Z1-Z1 perpendicular to the main scanning direction X1-X1. Further, the second carriage 6 is moved upward and downward to be docked with and separated from the first carriage 5 while the first and second carriage 5 and 6 are positioned side by side. Accordingly, a length of the recording device 100 in the main scanning direction X1-X1 can be reduced, thereby making the recording device 100 more compact.

A description is now given of coupling of the drive joint 19 and the second right joint 18R of the second carriage 6 while the second carriage 6 is lifted to the separation position to be separated from the first carriage 5 with reference to FIGS. 26 to 33.

Figure 26A:
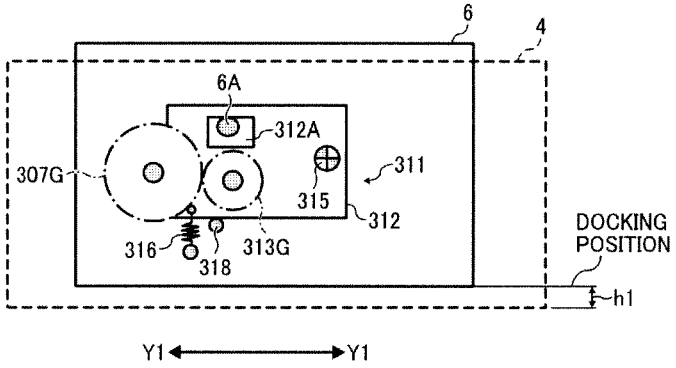
FIG. 26A is a side view illustrating a configuration of an operation body assembly viewed from the inside of the recording device when the second carriage is lowered to a docking position.
Figure 26B:
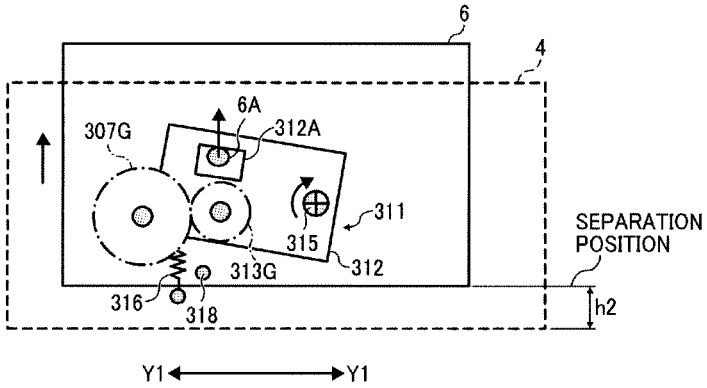
FIG. 26B is a side view illustrating a configuration of the operation body assembly viewed from the inside of the recording device when the second carriage is lifted to the separation position.
Figure 27:
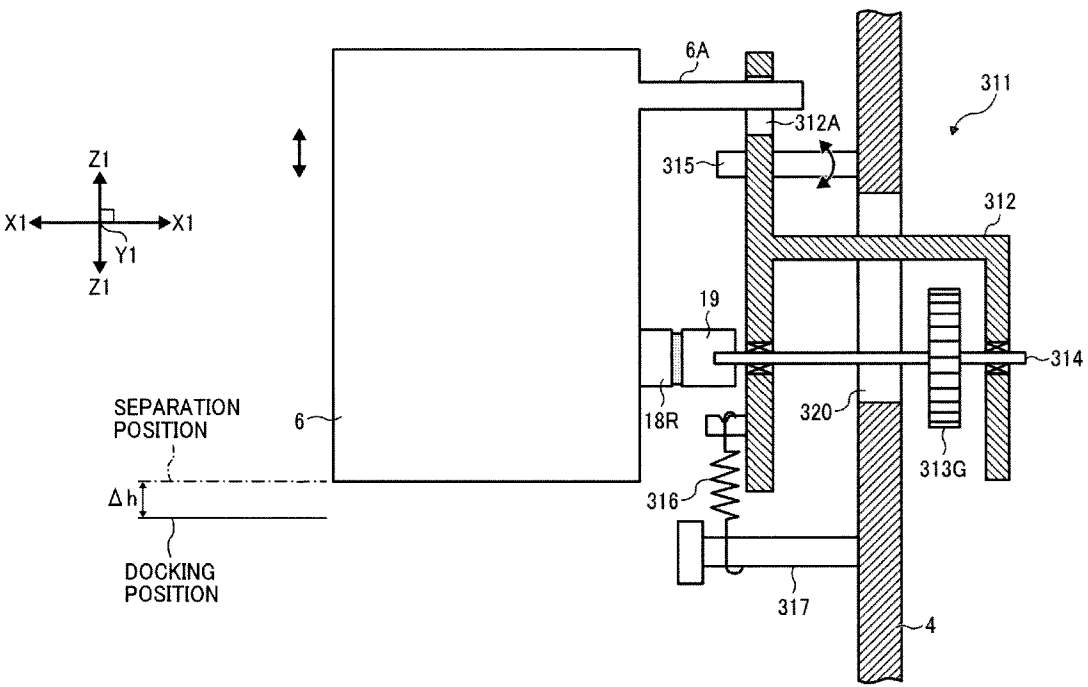
FIG. 27 is a partial vertical cross-sectional view illustrating relative positions of the second carriage and the operation body assembly viewed from a sub-scanning direction.
Figure 28:
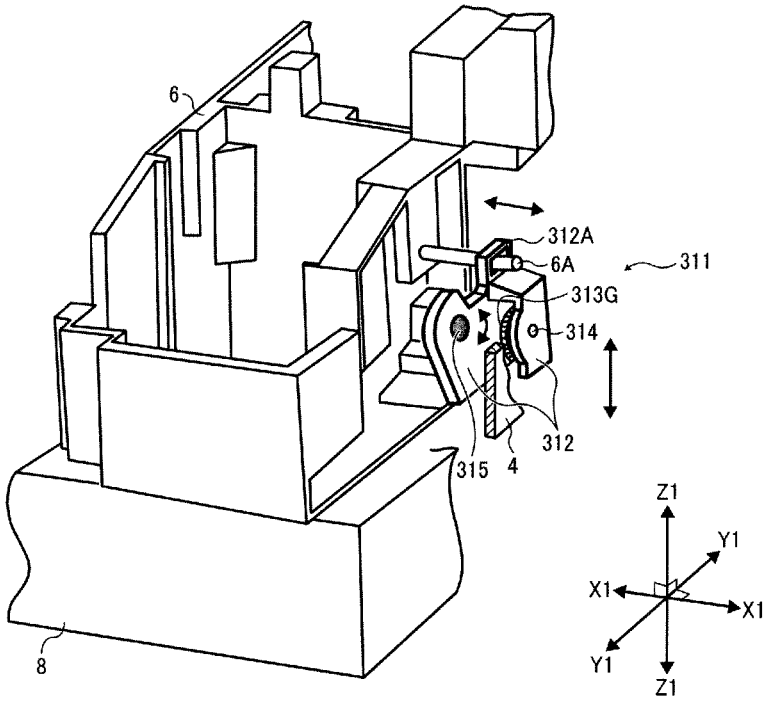
FIG. 28 is a partial perspective view illustrating engagement of a protrusion provided to the second carriage and the operation body assembly.
Figure 29:
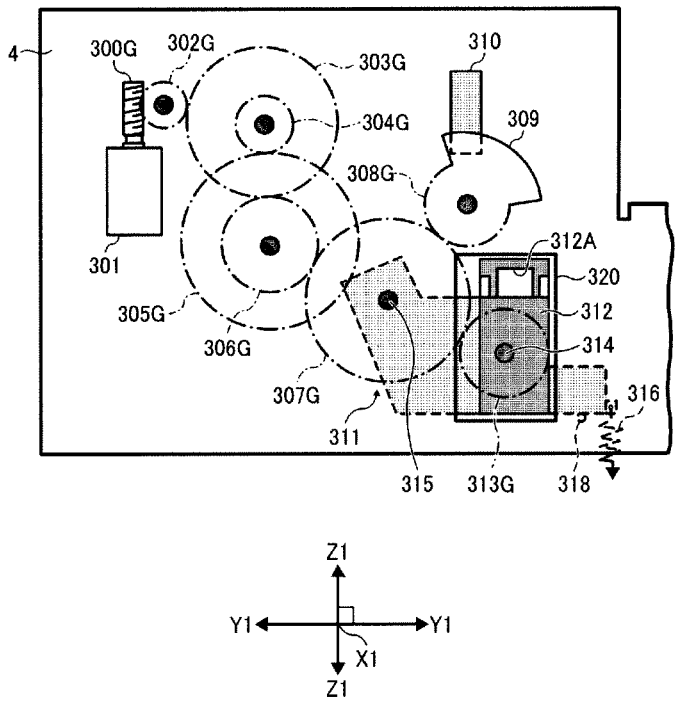
FIG. 29 is a side view illustrating relative positions of the operation body assembly and a drive source viewed from outside a right lateral plate.
Figure 30:
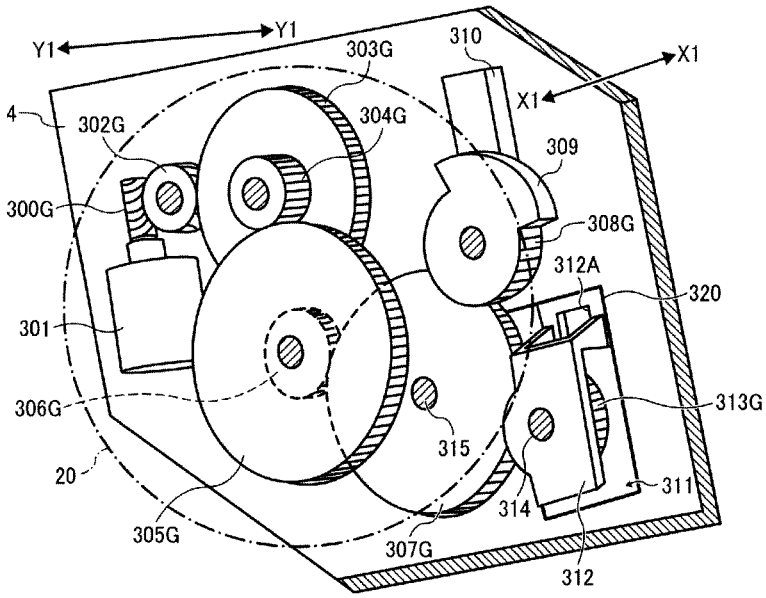
FIG. 30 is a perspective view illustrating a configuration of the drive source viewed from the inside of the recording device.
Figure 31:
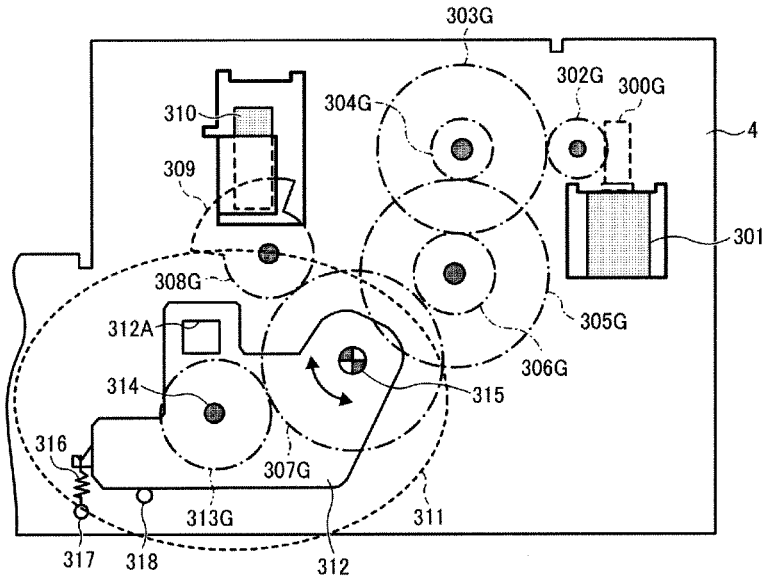
FIG. 31 is a side view illustrating the relative positions of the drive source and the operation body assembly viewed from the inside of the recording device.
Figure 32:
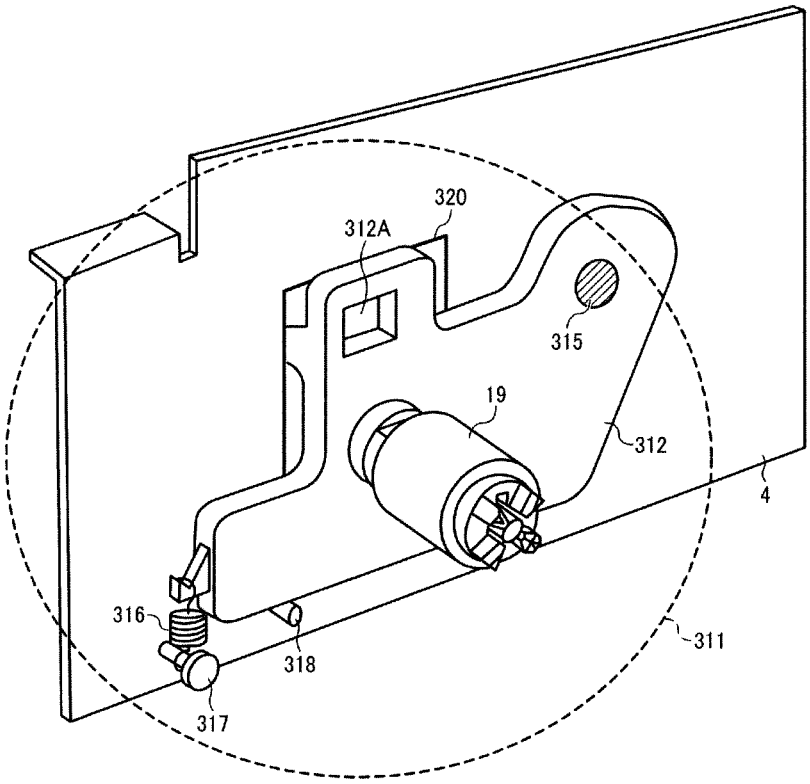
FIG. 32 is a perspective view illustrating a configuration of the operation body assembly viewed from the inside of the recording device.

FIG. 26A is a side view illustrating a configuration of an operation body assembly 311 viewed from the inside of the recording device 100 when the second carriage 6 is lowered to the docking position. FIG. 26B is a side view illustrating the configuration of the operation body assembly 311 viewed from the inside of the recording device 100 when the second carriage 6 is lifted to the separation position. FIG. 27 is a partial vertical cross-sectional view illustrating relative positions of the second carriage 6 and the operation body assembly 311 viewed from the sub-scanning direction Y1-Y1. FIG. 28 is a partial perspective view illustrating engagement of an operation body 312 and a protrusion 6A provided to the second carriage 6. FIG. 29 is a side view illustrating relative positions of the operation body assembly 311 and the drive source 20 viewed from outside the right lateral plate 4. FIG. 30 is a perspective view illustrating the configuration of the drive source 20 viewed from the inside of the recording device 100. FIG. 31 is a side view illustrating the relative positions of the drive source 20 and the operation body assembly 311 viewed from the inside of the recording device 100. FIG. 32 is a perspective view illustrating the configuration of the operation body assembly 311 viewed from the inside of the recording device 100.

As described previously, the drive joint 19 and the second right joint 18R of the second carriage 6 are coupled to each other when the first and second carriages 5 and 6 are docked with each other at the home positions thereof, thereby transmitting the driving force from the drive source 20 to drive the first and second lifting/lowering units 500 and 600. During monochrome image formation, the second carriage 6 is lifted to the separation position, that is, a position above and outside the main scanning range of the first carriage 5, and the first carriage 5 is moved away from the second carriage 6 in the main scanning direction X1-X1 so that the first and second carriages 5 and 6 are separated from each other.

Specifically, the pin members 201 are pushed upward from the maintenance mechanism 8 so that the second carriage 6 placed on the mounts 55 of the first carriage 5 is lifted to be moved to the separation position above the mounts 55. As shown in FIGS. 26A and 26B, a height h2 between the bottom of the right lateral plate 4 and the bottom of the second carriage 6 lifted to the separation position is larger than a height h1 between the bottom of the right lateral plate 4 and the bottom of the second carriage 6 placed on the mounts 55 of the first carriage 5. A height Δh shown in FIG. 27 is a difference between the heights h2 and h1.

When the second carriage 6 is lifted to the separation position, the second right joint 18R is also lifted together with the second carriage 6. Therefore, if the drive joint 19 is fixed to the right lateral plate 4 and is unmovable, relative positions of the second right joint 18R and the drive joint 19 coupled with each other are changed, thereby uncoupling the second right joint 18R from the drive joint 19.

In order to remain the second right joint 18R coupled to the drive joint 19 when the second carriage 6 is lifted to the separation position, the operation body assembly 311 serving as a follow-up unit is provided such that the drive joint 19 is movable together with the second right joint 18R and the second carriage 6 while remaining coupled to the second right joint 18R and the drive source 20.

The operation body assembly 311 includes the operation body 312 having a concavity 312A, a coupling gear 313G supported by the operation body 312, a shaft 314 that supports the coupling gear 313G, the drive joint 19 provided to the shaft 314, and so forth. The concavity 312A is integrally formed with the operation body 312, and has a hole that engages the protrusion 6A provided to the second carriage 6 described later. Both of the coupling gear 313G and the drive joint 19 are supported by the shaft 314 and are rotated in synchronization with each other. The shaft 314 is rotatably held by the operation body 312 and is movable together with the operation body 312. A pivot 315 that supports the operation body 312 is provided on the right lateral plate 4, and the operation body assembly 311 is rotatable around the pivot 315.

The drive source 20 disposed on the right lateral plate 4 includes a motor 301, a worm 300G provided to a rotary shaft of the motor 301, an idler gear 302G that engages the worm 300G, an idler gear 303G that engages the idler gear 302G, an idler gear 304G coaxially provided to the idler gear 303G, an idler gear 305G that engages the idler gear 304G, an idler gear 306G coaxially provided to the idler gear 305G, and an idler gear 307G that engages the idler gear 306G. The idler gear 307G is supported by the pivot 315 that also supports the operation body 312, and engages the coupling gear 313G supported by the operation body 312. The idler gear 307G also engages an idler gear 308G to which a shielding plate 309 is provided. The shielding plate 309 passes through a detection range of a photosensor 310 while rotated together with the idler gear 308G so that rotation of the operation body 312 is monitored. As described above, the shaft 314 that supports the coupling gear 313G also supports the drive joint 19.

The driving force for lifting and lowering the first and second recording heads 71 to 75 corresponding to the thickness of the sheet 150 is transmitted from the motor 301 to the coupling gear 313 through the idler gears 302G, 303G, 304G, 305G, 306G, and 307G, in that order. Accordingly, the drive joint 19 is rotated via the coupling gear 313G and the shaft 314.

The second carriage 6 has the protrusion 6A extending in the main scanning direction X1-X1 on a right lateral surface thereof. When the second carriage 6 is positioned at the home position, an upper end of the protrusion 6A contacts an upper end of the concavity 312A so that the protrusion 6A is inserted into the concavity 312A.

Accordingly, when the second carriage 6 is lifted to the separation position at the home position thereof, an upward force that lifts the concavity 312A acts on the concavity 312A into which the protrusion 6A is inserted, so that the operation body assembly 311 is rotated around the pivot 315. As a result, the second right joint 18R and the drive joint 19 are lifted along with upward movement of the second carriage 6, thereby remaining the second right joint 18R and the drive joint 19 coupled to each other. In addition, a spring hook 317 is provided on the right lateral plate 4, and a spring 316 is provided between the spring hook 317 and the operation body 312 so that tension that pulls the operation body 312 downward is constantly applied to the operation body 312. Rotation of the operation body 312 by the spring 316 is stopped by a stopper 318 provided on the right lateral plate 4 in synchronization with restoration of the second carriage 6 to the docking position so that the operation body 312 is stopped in a state corresponding to the docking position of the second carriage 6.

The heights of the second carriage 6 and the operation body assembly 311 are decided based on a state in which the upper end of the protrusion 6A contacts the upper end of the hole of the concavity 312A. The coupling gear 313G is provided to the right end of the shaft 314 in the main scanning direction X1-X1, and the drive joint 19 is provided at the left end thereof. The right lateral plate 4 has an opening 320 corresponding to rotation ranges of the shaft 314 and the operation body 312 such that the shaft 314 and the operation body 312 do not collide against the right lateral plate 4.

Accordingly, even when the second carriage 6 is lifted to the separation position during monochrome image formation, the relative positions of the drive joint 19 and the second right joint 18R of the second carriage 6 coupled to each other are not changed. In addition, damage to the drive joint 19 and the second right joint 18R caused by a shift in the relative positions thereof in the vertical direction Z1-Z1 is prevented. Further, the drive joint 19 is movable along with movement of the second carriage 6 while coupled to the second right joint 23R, thereby achieving smooth movement of the second carriage 6 to the separation position. It is to be noted that, alternatively, the protrusion 6A may be provided to the operation body 312 and the concavity 312A may be provided to the second carriage 6.

Because the second carriage 6 is lifted to the separation position, the height of the first carriage 5 is different from that of the second carriage 6 during monochrome image formation. At this time, the drive joint 19 and the second right joint 18R remain coupled to each other by rotation of the operation body assembly 311. However, because the height of the first right joint 23R of the first carriage 5 is different from that of the second left joint 18L of the second carriage 6, the first right joint 23R and the second left joint 18L are not coupled to each other.

For example, in a case in which the user opens a cover of the recording device 100 and changes the height of the first head holder 27 of the first carriage 5 by manually operating the first lifting/lowering units 500 while the first and second carriages 5 and 6 are separated from each other, the heights of the first recording heads 71 and 72 remain shifted from the heights of the second recording heads 73 to 75 when an operating mode is switched from monochrome image formation to full-color image formation and the second carriage 6 is lowered to the docking position to be docked with the first carriage 5. Consequently, the gap L between the recording surface of the sheet 150 and the first nozzle surfaces 71*a* and 72*a* of the first recording heads 71 and 72 is different from the gap L between the recording surface of the sheet 150 and the second nozzle surfaces 73*a* to 75*a* of the second recording heads 73 to 75, causing irregular images.

In order to solve the above-described problems, before the first and second carriages 5 and 6 are docked with each other, the motor 301 is driven while the second carriage 6 remains lifted at the separation position. Accordingly, the driving force is transmitted from the motor 301 to the coupling gear 313 through the idler gears 302G, 303G, 304G, 305G, 306G, and 307G, in that order. Because the drive joint 19 and the second right joint 18R remain coupled to each other while the second carriage 6 is lifted to the separation position or lowered to the docking position, the driving force is reliably transmitted from the drive source 20 to the second right joint 18R through the drive joint 19.

As described above, the operation body 312 is rotatable around the pivot 315 to perform predetermined constrained motion in conjunction with the movement of the second carriage 6 in the vertical direction Z1-Z1. The drive joint 19 is provided to the operation body 312 to be moved along with the movement of the second carriage 6 in the vertical direction Z1-Z1.

The operation body assembly 311 serves as the follow-up unit that moves the drive joint 19 in conjunction with the movement of the second carriage 6 between the docking and separation positions in the vertical direction Z1-Z1. Accordingly, the driving force is reliably transmitted from the drive source 20 to the second right joint 18R of the second carriage 6 through the drive joint 19 regardless of whether the second carriage 6 is lifted or lower to the separation position or the docking position.

The driving force is then transmitted from the second right joint 18R to the second lifting/lowering units 600 through the second coupling assembly 18 to lift or lower the second head holder 28. Accordingly, the heights of the second recording heads 73 to 75 are appropriately adjusted.

However, when the second carriage 6 is lifted to the separation position, the heights of the second left joint 18L of the second carriage 6 and the first right joint 23R of the first carriage 5 are shifted from each other and the second left joint 18L is not coupled to the first right joint 23R. Therefore, the driving force is not further transmitted to the first lifting/lowering units 500, and the first head holder 27 and the first recording heads 71 and 72 are not moved.

As described previously, the sensor 25 is provided to the first carriage 5 to detect the height of the first head holder 27 in the vertical direction Z1-Z1. The second carriage 6 also has the sensor 25 that similarly detects the height of the second head holder 28. When only the second head holder 28 is lowered or lifted as described above, the heights of the first and second head holders 27 and 28 are monitored by the respective sensors 25 so that a difference in the heights between the first and second head holders 27 and 28 is detected. The height of the second head holder 28 is adjusted based on the detected results to coincide with the height of the first head holder 27. Accordingly, even when the height of the first head holder 27 is manually moved by the user, the heights of the first and second recording heads 71 to 75 are reliably coincided with one another.

Figure 33:
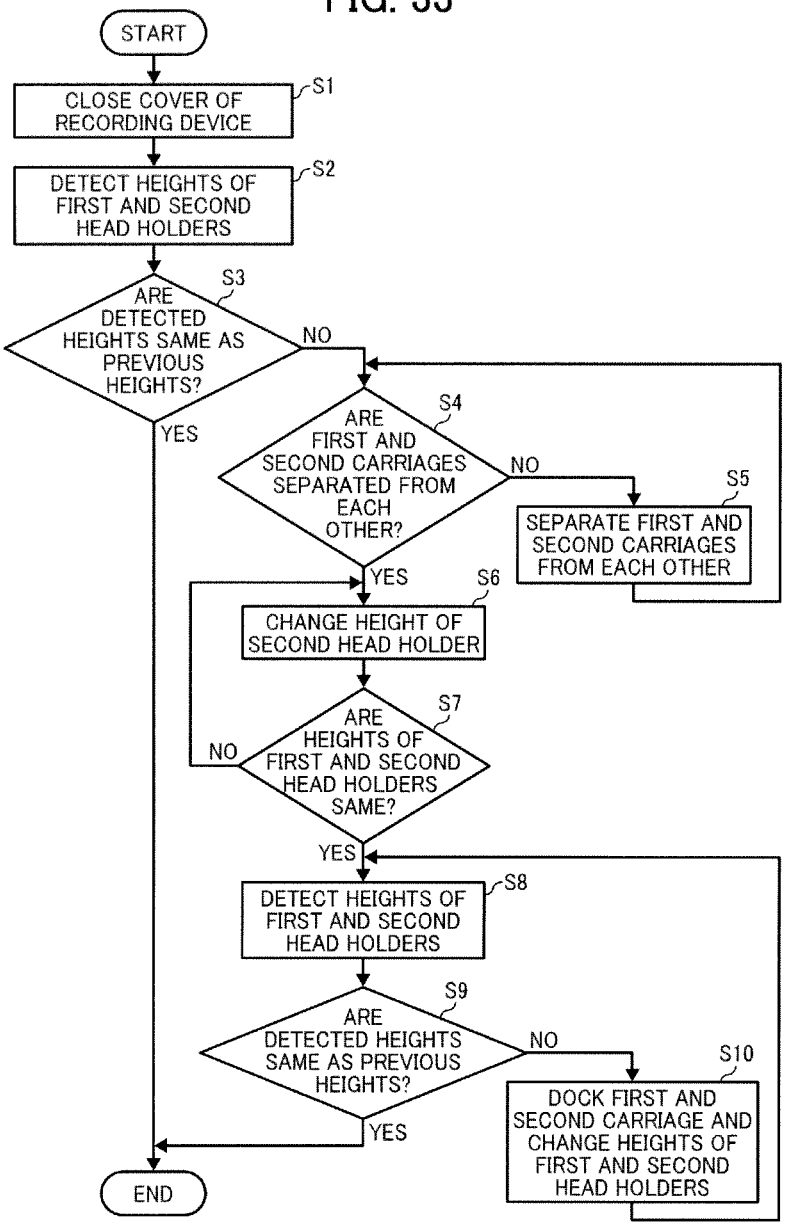
FIG. 33 is a flowchart illustrating steps in a process of adjustment of heights of the first and second carriages.

A description is now given of steps in a process of adjustment of the heights of the first and second recording heads 71 to 75 with reference to FIG. 33. FIG. 33 is a flowchart illustrating steps in a process of adjustment of the heights of the first and second head holders 27 and 28.

At step S1, the cover of the recording device 100 opened is closed. At S2, the heights of the first and second head holders 27 and 28 are detected by the respective sensors 25. At S3, whether or not the heights of the first and second head holders 27 and 28 thus detected coincide with previous heights thereof detected prior to opening of the cover of the recording device 100 is determined. When the detected heights coincide with the previous heights (YES at S3), the process is completed. However, when the detected heights do not coincide with the previous heights (NO at S3), the process proceeds to S4 to determine whether or not the first and second carriages 5 and 6 are separated from each other. When the first and second carriages 5 and 6 are not separated from each other (NO at S4), the process proceeds to S5 to separate the first and second carriages 5 and 6 from each other. Because the heights of the first and second head holders 27 and 28 cannot be coincided with each other when the first and second carriages 5 and 6 are not separated, the first and second carriages 5 and 6 need to be separated from each other at S5.

When the first and second carriages 5 and 6 are separated from each other (YES at S4), the process proceeds to S6 to adjust the height of the second head holder 28 as described previously. Next, at S7, whether or not the heights of the first and second head holders 27 and 28 coincide with each other is determined. When the height of the second head holder 28 does not coincide with the height of the first head holder 27 (NO at S7), the process returns to S6 to adjust the height of the second head holder 28 again. The processes of S6 and S7 are repeatedly performed until the height of the second head holder 28 coincides with the height of the first head holder 27. When the height of the second head holder 28 coincides with the height of the first head holder 27 (YES at S7), the process proceeds to S8 to detect the heights of the first and second head holders 27 and 28 again.

Similar to the process of S2, the heights of the first and second head holders 27 and 28 are detected by the respective sensors 25 at S8. At S9, whether or not the heights of the first and second head holders 27 and 28 thus detected coincide with the previous heights thereof is determined. When the detected heights do not coincide with the previous heights (NO at S9), the process proceeds to S10 to dock the first and second carriages 5 and 6 with each other and change the heights of the first and second head holders 27 and 28. Thereafter, the process returns to S8 to detect the heights of the first and second head holders 27 and 28. Change of the heights of the first and second head holders 27 and 28 is repeatedly performed until the detected heights coincide with the previous heights. When the detected heights coincide with the previous heights (YES at S9), the process is completed.

The above-described processes may be performed to change the height of the second head holder 28 which is moved by the user or the like to coincide the heights of the first and second head holders 27 and 28 with each other.

As described above, when the heights of the first and second head holders 27 and 28 are shifted from each other, only the height of the second head holder 28 is changed to coincide the heights of the first and second head holders 27 and 28 with each other, thereby preventing irregular images. Further, the configuration to transmit the driving force are simplified and made compact, thereby making the configuration of the image forming apparatus 1000 simpler and more compact.

According to the second illustrative embodiment, the second right joint 18R of the second carriage 6 and the drive joint 19 are coupled to each other while the first and second carriages 5 and 6 are separated from each other and the second left joint 18L of the second carriage 6 and the first right joint 23R of the first carriage 5 are not coupled to each other. Accordingly, even when only the first carriage 5 is manually lifted or lowered by the user and the heights of the first and second head holders 27 and 28 are shifted from each other, only the height of the second carriage 6 is adjusted to coincide the heights of the first and second head holders 27 and 28. Thereafter, the first and second carriages 5 and 6 are docked with each other and the heights of the first and second recording heads 71 to 75 are appropriately adjusted based on the thickness of the sheet 150. As a result, the gap L between the first and second nozzle surfaces 71*a* to 75*a* of the first and second recording heads 71 to 75, on the one hand, and the recording surface of the sheet 150, on the other, is kept constant regardless of the types of the sheet 150, thereby providing higher quality images.

Adjustment of the height of the second head holder 28 in order to coincide the heights of the first and second head holders 27 and 28 according to the second illustrative embodiment is applicable to the image forming apparatus 1000 according to the first illustrative embodiment in a case in which, for example, the first and second carriages 5 and 6 are separated and the second left joint 18L of the second carriage 6 and the first right joint 23R of the first carriage 5 are not coupled to each other.

As can be appreciated by those skilled in the art, numerous additional modifications and variations are possible in light of the above teachings. It is therefore to be understood that within the scope of the appended claims, the disclosure of this patent specification may be practiced otherwise than as specifically described herein. For example, elements and/or features of different illustrative embodiments may be combined with each other and/or substituted for each other within the scope of this disclosure and appended claims.

This patent specification is based on Japanese Patent Application Nos. 2009-282267, filed on Dec. 11, 2009, and 2010-061178, filed on Mar. 17, 2010, both in the Japan Patent Office, each of which is hereby incorporated herein by reference in its entirety.

What is claimed is:

1. An image forming apparatus comprising:

a first carriage movable in a main scanning direction and having a first recording head configured to eject a recording liquid and a first lifting/lowering unit that moves the first recording head upward and downward in a direction perpendicular to a surface of a recording medium;

a second carriage movable in the main scanning direction and having a second recording head configured to eject another recording liquid and a second lifting/lowering unit that moves the second recording head upward and downward in the direction perpendicular to the surface of the recording medium;

a drive source that drives the first and second lifting/lowering units by using a driving force generated by the drive source to move the first and second recording heads upward and downward;

a drive coupling unit coupled to the drive source;

a first coupling unit provided on the first carriage;

a second coupling unit provided on the second carriage, wherein a first end of the second coupling unit is coupled to the drive coupling unit to transmit the driving force from the drive source to the second lifting/lowering unit to move the second recording head upward and downward, and a second end of the second coupling unit opposite he first end of the second coupling unit is coupled to the first coupling unit to allow the driving force to be transmitted via the first coupling unit to the first lifting/lowering unit to move the first recording head upward and downward;

a docking/separation unit that docks and separates the first and second carriages with and from each other; and an accommodation/coupling unit that couples the first coupling unit to the second end of the second coupling unit to allow the driving force to be transmitted via the first coupling unit to the first lifting/lowering unit and accommodates the first coupling unit within the first carriage to uncouple the first coupling unit from the second end of the second coupling unit, wherein accommodation and coupling of the first coupling unit by the accommodation/coupling unit are performed in conjunction with docking and separation of the first and second carriages by the docking/separation unit.

2. The image forming apparatus according to claim 1, wherein the first coupling unit is coupled to the second end of the second coupling unit by the accommodation/coupling unit after the first and second carriages are docked with each other by the docking/separation unit.

3. The image forming apparatus according to claim 1, wherein the first and second lifting/lowering units remain static during coupling and uncoupling of the first coupling unit to and from the second end of the second coupling unit and accommodation of the first coupling unit within the first carriage.

4. The image forming apparatus according to claim 1, wherein:

the first carriage is movable reciprocally back and forth in the main scanning direction;

the second carriage is movable in the main scanning direction together with the first carriage when docked with the first carriage by the docking/separation unit:

the drive source is disposed at one end of the image forming apparatus in the main scanning direction; and the second carriage is disposed between the first carriage and the drive source.

5. The image forming apparatus according to claim 4, wherein:

the second carriage is moved to a home position of the second carriage close to the drive source to couple the first end of the second coupling unit to the drive coupling unit;

the first carriage is moved to a home position of the first carriage adjacent to the home position of the second carriage to be docked with the second carriage positioned at the home position of the second carriage; and accommodation and coupling of the first coupling unit by the accommodation/coupling unit and docking and separation of the first and second carriages by the docking/separation unit are performed when the first and second carriages are positioned at their respective home positions.

6. The image forming apparatus according to claim 1, wherein the first lifting/lowering unit comprises:

a first head holder supported within the first carriage and holding the first recording head, movement of the first head holder restricted only to upward and downward directions;

an elastic member that biases the first head holder in the upward and downward directions;

a slide cam supported by the first carriage to move reciprocally in a sub-scanning direction perpendicular to the main scanning direction, the slide cam supporting the first head holder biased by the elastic member and having a first rack having teeth extending in the main scanning direction at one end thereof; and a first pinion engaging the first rack, the first pinion being coaxially provided with the first coupling unit.

7. The image forming apparatus according to claim l, wherein the second lifting/lowering unit comprises:

a second head holder supported within the second carriage and holding the second recording head, movement of the second head holder restricted only to upward and downward directions;

an elastic member that biases the second head holder in the upward and downward directions;

a slide cam supported by the second carriage to move reciprocally in a sub-scanning direction perpendicular to the main scanning direction, the slide cam supporting the second head holder biased by the elastic member and having a rack having teeth extending in the main scanning direction at one end thereof; and a pinion engaging the rack, the pinion being coaxially provided with the second coupling unit.

8. The image forming apparatus according to claim 6, wherein the accommodation/coupling unit comprises:

a support shaft that coaxially holds the first pinion and the first coupling unit;

a supporter that supports the support shaft movably in the main scanning direction and rotatably in the first carriage;

an accommodation guide that is a cam follower provided to the supporter;

a biasing member that biases and moves the first pinion, the first coupling unit, the support shaft, and the accommodation guide toward the second coupling unit;

an accommodation cam that contacts the accommodation guide to stop movement of the support shaft by the biasing member and is rotated to couple the first coupling unit to the second end of the second coupling unit or to accommodate the first coupling unit uncoupled from the second end of the second coupling unit; and an accommodation cam drive source that rotates the accommodation cam.

9. The image forming apparatus according to claim 8, wherein the docking/separation unit comprises:

a docking member movable reciprocally between a docking position to dock the first and second carriages with each other and a separation position to separate the first and second carriages from each other; and a driving mechanism to displace the docking member, the driving mechanism comprises:

a guide member that restricts a direction of reciprocating movement of the docking member;

a second rack formed on the docking member;

a second pinion engaging the second rack and which is rotated to reciprocally move the docking member; and a gear drive source that rotates the second pinion, the gear drive source is the accommodation cam drive source.

10. The image forming apparatus according to claim 9, wherein the accommodation cam contacting the accommodation guide in a direction of rotation of the accommodation cam and the second rack engaging the second pinion in the direction of the reciprocating movement of the docking member are positioned to couple the first coupling unit to the second end of the second coupling unit by the accommodation/coupling unit after docking of the first and second carriages by the docking/separation unit.

11. The image forming apparatus according to claim 1, wherein the drive coupling unit is coupled to the first end of the second coupling unit while remaining coupled to the drive source in a state in which the first coupling unit and the second end of the second coupling unit are not coupled to each other and the first and second carriages are separated from each other.

12. The image forming apparatus according to claim 11, further comprising a separation mechanism that moves the second carriage from a docking position where the first and second carriages are docked with each other to a separation position outside a scanning range of the first carriage separate the first and second carriages from each other, wherein the drive coupling unit is coupled to the first end of the second coupling unit to transmit the driving force regardless of whether the second carriage is positioned at the docking position or the separation position.

13. The image forming apparatus according to claim 12, further comprising a follow-up unit that moves the drive coupling unit in conjunction with the movement of the second carriage between the docking position and the separation position to transmit the driving force from the drive source to the second coupling unit.

14. The image forming apparatus according to claim 13, wherein the follow-up unit comprises an operation body that engages the second carriage to perform predetermined constrained motion in conjunction with the movement of the second carriage, the operation body being provided with the drive coupling unit to move the drive coupling unit in conjunction with the movement of the second carriage.

15. The image forming apparatus according to claim 14, wherein the operation body has a pivot around which the operation body is rotated to perform the predetermined constrained motion, and the rotation of the operation body moves the drive coupling unit in conjunction with the movement of the second carriage.

16. The image forming apparatus according to claim 12, wherein the separation mechanism comprises a pushing member provided facing the first and second carriages at home positions of the first and second carriages, the pushing member being pushed from a maintenance unit that services the first and second recording heads to a bottom surface of the second carriage to move the second carriage to the separation position.

17. The image forming apparatus according to claim 1, wherein the first lifting/lowering unit moves the first recording head upward or downward after (i) the docking/separation unit docks the first carriage and the second carriage together and (ii) the accommodation/coupling unit couples the first coupling unit to the second end of the second coupling unit.

* * * * *